US008179346B2

(12) United States Patent
Chung et al.

(10) Patent No.: US 8,179,346 B2
(45) Date of Patent: May 15, 2012

(54) METHODS AND APPARATUS FOR DRIVING LIQUID CRYSTAL DISPLAY DEVICE

(75) Inventors: Chun-Fan Chung, Hsinchu (TW); Sheng-Kai Hsu, Hsinchu (TW); Chih-Hsiang Yang, Hsinchu (TW)

(73) Assignee: AU Optronics Corporation, Hsinchu (TW)

( * ) Notice: Subject to any disclaimer, the term of this patent is extended or adjusted under 35 U.S.C. 154(b) by 1205 days.

(21) Appl. No.: 11/941,537

(22) Filed: Nov. 16, 2007

(65) Prior Publication Data

US 2009/0128466 A1 May 21, 2009

(51) Int. Cl.
*G09G 3/36* (2006.01)

(52) U.S. Cl. ..... 345/88; 345/96; 345/98

(58) Field of Classification Search ..... 345/204, 345/87–100

See application file for complete search history.

(56) References Cited

U.S. PATENT DOCUMENTS 6,822,718 B2 11/2004 Choi et al.
7,477,224 B2 1/2009 Song et al.
2003/0197823 A1 10/2003 Song
2006/0284819 A1 12/2006 Lin et al.
2007/0229434 A1* 10/2007 Liao ..... 345/98
2007/0296676 A1* 12/2007 Moon et al. ..... 345/98

FOREIGN PATENT DOCUMENTS

CN 1427391 A 7/2003
JP 643424 2/1994
JP 2001282170 A 10/2001
JP 2003233362 A 8/2003

* cited by examiner

*Primary Examiner* — Regina Liang
(74) *Attorney, Agent, or Firm* — Morris Manning & Martin LLP; Tim Tingkang Xia, Esq.

(57) ABSTRACT

A driving circuit for driving a display panel comprising: (i) a printed circuit board, (ii) an input interface to receive input video signal, (iii) a timing controller to control timing signal for the display panel, (iv) a plurality of first source drivers, and (v) at least one second source driver, and wherein the display cells connected to the i-th data line and the (2j+1)-th or (2j+2)-th gate line, where j=0, 2, 4, . . . , <[Y/2], and i=1, 2, . . . , M, where Y and M are positive integers, receive data signals from corresponding data lines 1 through M, respectively, and the display cells connected to the (i+1)-th data line and the (2j+1)-th or (2j+2)-th gate line, where j=1, 3, . . . , <[Y/2]+1, and i=1, 2, . . . , M, receive shifted data signals from the data lines 2 through M+1, respectively.

17 Claims, 19 Drawing Sheets

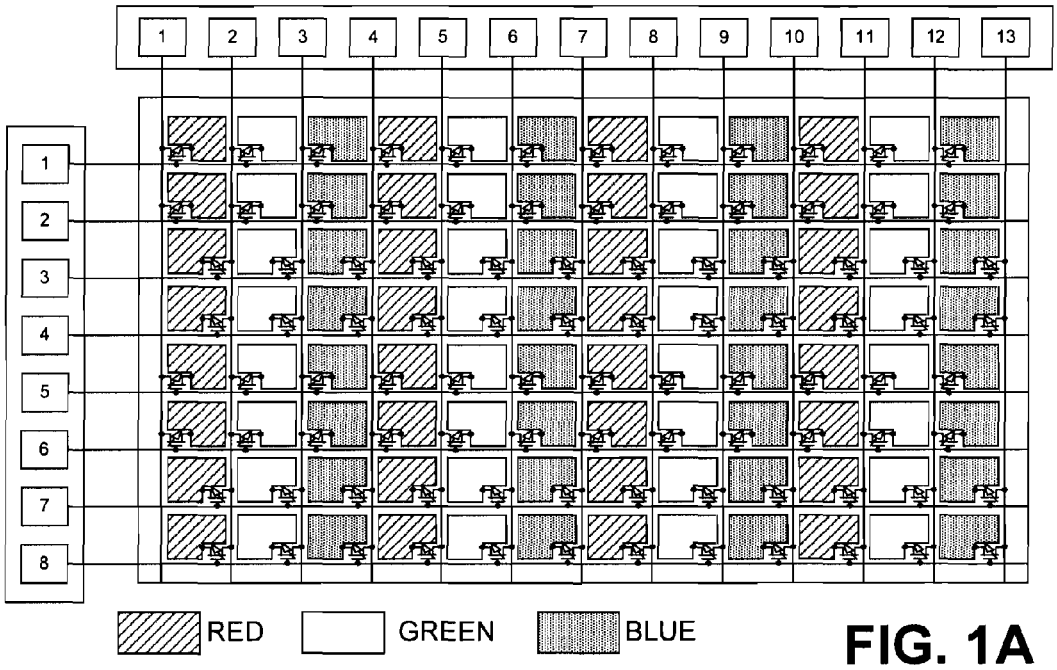
FIG. 1A
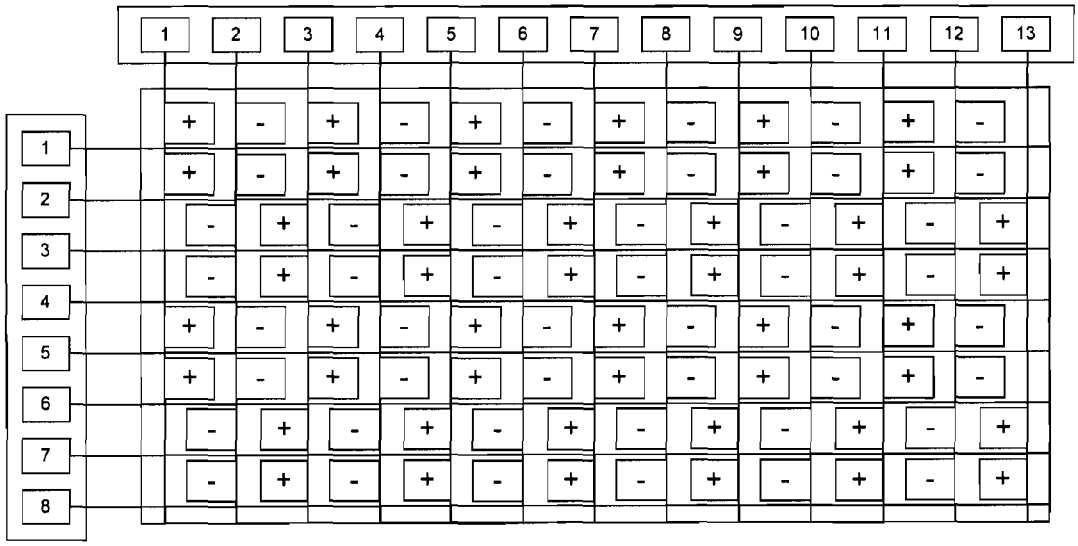
FIG. 1B
FIG. 1

| | | | | SD | SD | SD | SD | SD | SD | SD | SD | SD | SD | SD | SD | SD | SD | SD |
|---|---|---|---|---|---|---|---|---|---|---|---|---|---|---|---|---|---|---|
| RES. | HOR. | VER. | | 414 | 432 | 480 | 516 | 540 | 576 | 615 | 618 | 640 | 642 | 684 | 720 | 768 | 960 | 1026 |
| XGA | 1024 | 768 | REQ | 8 | 8 | 7 | 6 | 6 | 6 | 5 | 5 | 5 | 5 | 5 | 5 | 4 | 4 | 3 |
| | | | UN. | 240 | 384 | 288 | 24 | 168 | 384 | 3 | 18 | 128 | 138 | 348 | 528 | 0 | 768 | 6 |
| WXGA | 1280 | 800 | REQ | 10 | 9 | 8 | 8 | 8 | 7 | 7 | 7 | 6 | 6 | 6 | 6 | 5 | 4 | 4 |
| | | | UN. | 300 | 48 | 0 | 288 | 480 | 192 | 465 | 486 | 0 | 12 | 264 | 480 | 0 | 0 | 264 |
| WXGA | 1366 | 768 | REQ | 10 | 10 | 9 | 8 | 8 | 8 | 7 | 7 | 7 | 7 | 6 | 6 | 6 | 5 | 4 |
| | | | UN. | 42 | 222 | 222 | 30 | 222 | 510 | 207 | 228 | 382 | 396 | 6 | 222 | 510 | 702 | 6 |
| WSXGA | 1440 | 900 | REQ | 11 | 10 | 9 | 9 | 8 | 8 | 8 | 7 | 7 | 7 | 7 | 6 | 6 | 5 | 5 |
| | | | UN. | 234 | 0 | 0 | 324 | 0 | 288 | 600 | 6 | 160 | 174 | 468 | 0 | 288 | 480 | 810 |
| SXGA | 1280 | 1024 | REQ | 10 | 9 | 8 | 8 | 8 | 7 | 7 | 7 | 6 | 6 | 6 | 6 | 5 | 4 | 4 |
| | | | UN. | 300 | 48 | 0 | 288 | 480 | 192 | 465 | 486 | 0 | 12 | 264 | 480 | 0 | 0 | 264 |
| HDTV | 1920 | 1080 | REQ | 14 | 14 | 12 | 12 | 11 | 10 | 10 | 10 | 9 | 9 | 9 | 8 | 8 | 6 | 6 |
| | | | UN. | 36 | 288 | 0 | 432 | 180 | 0 | 390 | 420 | 0 | 18 | 396 | 0 | 384 | 0 | 396 |

NEED TO ADD CHANNEL ACCORDING TO EMBODIMENTS OF THE PRESENT INVENTION

FIG. 9

METHODS AND APPARATUS FOR DRIVING LIQUID CRYSTAL DISPLAY DEVICE

FIELD OF THE INVENTION

The present invention relates generally to methods and apparatuses for driving liquid crystal display devices.

BACKGROUND OF THE INVENTION

Generally, a liquid crystal display device typically includes a liquid crystal display (hereinafter "LCD") panel having a plurality of liquid crystal cells arranged in the form of an M×N matrix, and a driving circuit for driving the LCD device. The light transmittance characteristic of the liquid crystal cells is controlled by the LCD device according to the input video signals, and corresponding images are displayed on the LCD device.

An LCD device usually has M gate lines, and N data lines of liquid crystal cells. The liquid crystal cells are located at areas defined by crossings of gate lines and data lines. Each liquid crystal cell has a common electrode and a pixel electrode with which an electric field may be generated. Each pixel electrode is connected to a corresponding data line via a switching device such as a thin film transistor (TFT). A terminal of a TFT is connected to a gate line such that video signals may be applied to corresponding pixel electrodes. The driving circuit includes a gate driver for driving M gate lines, a data driver for driving N data lines, and a common voltage generator for driving the common electrode.

The gate driver applies the gate signal to one gate line at a time, and the data line applies data signal to all the data lines at a time. A liquid crystal cell Cn,m is displaying a portion of an image when its gate line is supplied with gate signal, and its data line is supplied with data signal at the same time. Depending on the video signal applied to the data line, an orientation of molecules of liquid crystal material provided within the liquid crystal cell, between the pixel and common electrode, may be altered and the light transmittance of the liquid crystal cell may be controlled. Accordingly, as the light transmittances of each of the liquid crystal cells in the LCD device are individually controlled, the LCD device may display a picture.

In order to increase the contrast of the LCD device, a number of inversion methods are used. As known to those skilled in the art, these inversion methods include the following:

1. Frame inversion: if driven according to the frame inversion method, the polarity of data signals supplied to the liquid crystal cells is inverted every frame;
2. Line inversion: if driven according to the line inversion method, the polarity of data signals supplied to the liquid crystal cells connected to a gate line is opposite of the polarity of data signals supplied to liquid crystal cells connected to gate lines next to that gate line, and the polarities of the data signals applied to the liquid crystal cells are inverted every frame;
3. Column inversion: if driven according to the column inversion method, the polarity of data signals supplied to the liquid crystal cells connected to a data line is opposite of the polarity of data signals supplied to liquid crystal cells connected to data lines next to that data line, and the polarities of the data signals applied to the liquid crystal cells are inverted every frame; and
4. Dot inversion: when driven according to the dot inversion method, a polarity of data signal supplied to a liquid crystal cell is opposite of the polarity of data signals supplied to liquid crystal cells neighboring to that liquid crystal cell, and the polarities of the data signals applied to the liquid crystal cells are inverted every frame.

The LCDs driven using the frame inversion do not provide great contrast improvement of the displayed image. The LCDs driven using the line inversion and the column inversion exhibit flicker possibly caused by electrical cross-talk between the liquid crystal cells positioned along the horizontal gate lines, or vertical data lines. The pictures/images generated by the LCD device driven with the dot inversion method have superior quality over pictures/images generated by the LCD driven with any other inversion methods.

On the other hand, the disadvantage of the LCDs driven with the dot inversion method is that the polarity of video signals supplied from the data driver to the data line needs to be inverted in both horizontal and vertical directions and individual pixel voltages required by the dot inversion method are typically greater than those required by other inversion methods. Therefore, LCD device driven with the dot inversion method typically consume a relatively large amount of power during its operation.

Therefore, a heretofore unaddressed need exists in the art to address the aforementioned deficiencies and inadequacies.

SUMMARY OF THE INVENTION

The present invention, in one aspect, relates to a display panel driving circuit for driving a display panel. The display panel has Y successive gate lines, M+1 successive data lines crossing the Y gate lines forming a plurality of crossing points of the Y gate lines and M+1 data lines, where M and Y are positive integers, and a plurality of display cells. These display cells are positioned at corresponding crossing points of the Y gate lines and M+1 data lines thereby to form a matrix with a plurality of columns {i=1, 2, . . . , M+1}. The display cells within column i positioned at the crossing points of the i-th data line and the (2j+1)-th or (2j+2)-th gate line are connected to the i-th data line, where j=0, 2, 4, . . . , <[Y/2]. The display cells within column i+1 positioned at the crossing points of the (i+1)-th data line and the (2j+1)-th or (2j+2)-th gate line are connected to the (i+1) data line, where j=1, 3, . . . , <[Y/2]+1. The i-th data line and the (i+1)-th data line have opposite data signal polarities, respectively. In one embodiment, the display panel driving circuit has: (i) a printed circuit board ("PCB"), (ii) an input interface adapted on the PCB to receive input video signal, (iii) a timing controller adapted on the PCB to control timing signal for the display panel, (iv) a plurality of first source drivers, and (v) at least one second source driver. The plurality of first source drivers and the at least one second source driver are configured such that each of the plurality of first source drivers drives N data lines, and the at least one second source driver drives N+1 data lines. where N is a positive integer no greater than M, respectively. The display cells within column i positioned at the crossing points of the i-th data line and the (2j+1)-th or (2j+2)-th gate line, where j=0, 2, 4, . . . , <[Y/2], and i=1, 2, . . . , M, receive data signals from corresponding data lines 1 through M, respectively. The display cells within column (i+1) positioned at the crossing points of the (i+1)-th data line and the (2j+1)-th or (2j+2)-th gate line, where j=1, 3, . . . , <[Y/2]+1, and i=1, 2, . . . , M, receive shifted data signals from the data lines 2 through M+1, respectively.

In one embodiment, the display panel has a liquid crystal display panel, and its display cells comprise liquid crystal cells. The input interface includes an RSDS input interface, and a Mini-LVDS input interface.

In one embodiment, each column of the display cells is driven by three sub pixel data lines mapped into a first output channel, a second output channel and a third output channel for expressing a red color, a green color, and a blue color, respectively. When the (2j+1)-th or (2j+2)-th gate line is scanned, where j=1, 3, . . . , <[Y/2]+1, an "invalid data" is inserted into the timing controller, the sub pixel data is shifted to form the shifted data such that red sub pixel data signal is shifted by one sub pixel and stored in a corresponding green output channel, the green sub pixel data signal is shifted by one sub pixel and stored in a corresponding blue output channel, and blue sub pixel data signal is shifted by one sub pixel and stored in a corresponding red output channel.

In another aspect, the present invention relates to a display panel driving circuit for driving a display panel The display panel has Y successive gate lines, M+1 successive data lines crossing the Y gate lines forming a plurality of crossing points of the Y gate lines and M+1 data lines, where M and Y are positive integers, and a plurality of display cells. These display cells are positioned at corresponding crossing points of the Y gate lines and M+1 data lines thereby to form a matrix with a plurality of columns {i=1, 2, . . . , M+1}. The display cells within column i positioned at the crossing points of the i-th data line and the (2j+1)-th or (2j+2)-th gate line are connected to the i-th data line, where j=0, 2, 4, . . . , <[Y/2]. The display cells within column i+1 positioned at the crossing points of the (i+1)-th data line and the (2j+1)-th or (2j+2)-th gate line are connected to the (i+1) data line, where j=1, 3, . . . , <[Y/2]+1. The i-th data line and the (i+1)-th data line have opposite data signal polarities, respectively. In one embodiment, the display panel driving circuit has: (i) a printed circuit board ("PCB"), (ii) an input interface adapted on the PCB to receive input video signal, (iii) a timing controller adapted on the PCB to control timing signal for the display panel, (iv) an output buffer for shifting a sub pixel data of the first data line to a sub pixel data of the M+1 data line, and (v) a plurality of source drivers, wherein each of the plurality of source drivers drives N data lines, where N is a positive integer no greater than M, respectively. The display cells within column i positioned at the crossing points of the i-th data line and the (2j+1)-th or (2j+2)-th gate line, where j=0, 2, 4, . . . , <[Y/2], and i=1, 2, . . . , M, receive data signals from corresponding data lines 1 through M, respectively. The display cells within column (i+1) positioned at the crossing points of the (i+1)-th data line and the (2j+1)-th or (2j+2)-th gate line, where j=1, 3, . . . , <[Y/2]+1, and i=1, 2, . . . , M, receive shifted data signals from the data lines 2 through M+1, respectively.

In one embodiment, the display panel is a liquid crystal display panel, and its display cells are liquid crystal cells. Each column of the display cells is driven by three sub pixel data lines mapped into a first output channel, a second output channel and a third output channel for expressing a red color, a green color, and a blue color, respectively. When the (2j+1)-th or (2j+2)-th gate line is scanned, where j=1, 3, . . . , <[Y/2]+1, the sub pixel data is shifted to form the shifted sub pixel data such that the first blue sub pixel data is shifted through the output buffer to the last M+1 output channel expressing a blue color, the red sub pixel data signal is shifted by one sub pixel and stored in a corresponding green output channel, the green sub pixel data signal is shifted by one sub pixel and stored in a corresponding blue output channel, and the blue sub pixel data signal is shifted by one sub pixel and stored in a corresponding red output channel.

In yet another aspect, the present invention relates to a display panel driving circuit for driving a display panel. The display panel has Y successive gate lines, M+1 successive data lines crossing the Y gate lines forming a plurality of crossing points of the Y gate lines and M+1 data lines, where M and Y are positive integers, and a plurality of display cells. These display cells are positioned at corresponding crossing points of the Y gate lines and M+1 data lines thereby to form a matrix with a plurality of columns {i=1, 2, . . . , M+1}. The display cells within column i positioned at the crossing points of the i-th data line and the (2j+1)-th or (2j+2)-th gate line are connected to the i-th data line, where j=0, 2, 4, . . . , <[Y/2]. The display cells within column i+1 positioned at the crossing points of the (i+1)-th data line and the (2j+1)-th or (2j+2)-th gate line are connected to the (i+1) data line, where j=1, 3, . . . , <[Y/2]+1. The i-th data line and the (i+1)-th data line have opposite data signal polarities, respectively. In one embodiment, the display panel driving circuit has: (i) a printed circuit board ("PCB"), (ii) an input interface adapted on the PCB to receive input video signal, (iii) a timing controller adapted on the PCB to control timing signal for the display panel, and (iv) K source drivers each coupled to the input interface, wherein each of K source drivers has N input data lines, N+1 output data channels, and (v) a set of switches to switch the N input data lines to N+1 output data channels, where N and K are positive integers, satisfying the relation of: K×N=M. The display cells within column i positioned at the crossing points of the ith data line and the (2j+1)-th or (2j+2)-th gate line, where j=0, 2, 4, . . . , <[Y/2], and i=1, 2, . . . , M, receive data signals from corresponding data lines 1 through M, respectively. The display cells within column (i+1) positioned at the crossing points of the (i+1)-th data line and the (2j+1)-th or (2j+2)-th gate line, where j=1, 3, . . . , <[Y/2]+1, and i=1, 2, . . . , M, receive switched data signals from the data lines 2 through M+1, respectively.

The display panel is a liquid crystal display panel, and its display cells are liquid crystal cells. Each column of the display cells is driven by three sub pixel data lines mapped into a first output channel, a second output channel and a third output channel for expressing a red color, a green color, and a blue color, respectively. When the (2j+1)-th gate line or (2j+2)-th gate line is scanned, where j=0, 2, 4, . . . , <[Y/2], the output data channels 1 through N of each of the K source drivers receive data signals from a first input data line through the N-th input data line, and the (N+1)-th output data channel becomes a floating output data channel. When (2j+1)-th gate line or (2j+2)-th gate line is scanned, where j=1, 3, . . . , <[Y/2]+1, output data channels 2 though N+1 of each of the K source drivers receive data signals from the first input data channel through the N-th input data channel, and the first output data channel becomes a floating output data channel. The first output channel of the k-th source driver is connected to the last output data channel of the (k−1)-th source driver, where k=2, 3, . . . , K.

In an additional aspect, the present invention relates to a display panel driving circuit for driving a display panel. The display panel has Y successive gate lines, M+1 successive data lines crossing the Y gate lines forming a plurality of crossing points of the Y gate lines and M+1 data lines, where M and Y are positive integers, and a plurality of display cells. These display cells are positioned at corresponding crossing points of the Y gate lines and M+1 data lines thereby to form a matrix with a plurality of columns {i=1, 2, . . . , M+1}. The display cells within column i positioned at the crossing points of the i-th data line and the (2j+1)-th or (2j+2)-th gate line are connected to the i-th data line, where j=0, 2, 4, . . . , <[Y/2]. The display cells within column i+1 positioned at the crossing points of the (i+1)-th data line and the (2j+1)-th or (2j+2)-th gate line are connected to the (i+1) data line, where j=1, 3, . . . , <[Y/2]+1. The i-th data line and the (i+1)-th data line have opposite data signal polarities, respectively. In one embodiment, the display panel driving circuit has: (i) a printed circuit board ("PCB"), (ii) an input interface adapted on the PCB to receive input video signal, (iii) a timing controller adapted on the PCB to control timing signal for the display panel, wherein the timing controller has M T-CON output channels, (iv) a plurality of output channels for driving the plurality of display cells, and (v) a plurality of driver data latches adapted on the PCB, wherein each of the plurality of driver data latches has one output data channel. The display cells within column i positioned at the crossing points of the ith data line and the (2j+1)-th or (2j+2)-th gate line, where j=0, 2, 4, . . . , <[Y/2], and i=1, 2, . . . , M, receive data signals from the T-CON output channels 1 through M, respectively. The display cells within column (i+1) positioned at the crossing points of the i+1th data line and the (2j+1)-th or (2j+2)-th gate line, where j=1, 3, . . . , <[Y/2]+1, and i=1, 2, M, receive shifted data signals from the T-CON output channels 2 through M+1, respectively.

In one embodiment, the display panel is a liquid crystal display panel, and its display cells are liquid crystal cells. Each column of the display cells is driven by three sub pixel data lines mapped into a first output channel, a second output channel and a third output channel for expressing a red color, a green color, and a blue color, respectively. The display panel driving circuit further includes a RSDS input interface. For the RSDS input interface, when the (2j+1)-th or (2j+2)-th gate line, where j=0, 2, 4, . . . , <[Y/2], is scanned, the driver data latches 1 through M receive the data signal from T-CON output channels 1 though M. When the (2j+1)-th or (2j+2)-th gate line, where j=1, 3, . . . , <[Y/2]+1, is scanned, the driver data latches 1 through M receive the data signal from T-CON output channels 1 though M, and every even numbered blue sub pixel data line is shifting by two sub pixels by the timing controller.

In one embodiment, the display panel driving circuit further includes a Mini-LVDS input interface. For the Mini-LVDS input interface, when the (2j+1)-th or (2j+2)-th gate line is scanned, where j=0, 2, 4, . . . , <[Y/2], the driver data latches 1 through M receive the data signal from T-CON output channels 1 though M, and when the (2j+1)-th or (2j+2)-th gate line is scanned, where j=1, 3, . . . , <[Y/2]+1, the driver data latches 1 through M receive the data signal from T-CON output channels 1 though M, and every even numbered blue sub pixel data line is shifting by two sub pixels by the timing controller.

Among other things, the present invention provides a new LCD device driving circuit and new methods, which provides superior pictures/image quality while reducing consumption of electrical power.

These and other aspects of the present invention will become apparent from the following description of the preferred embodiment taken in conjunction with the following drawings, although variations and modifications therein may be affected without departing from the spirit and scope of the novel concepts of the disclosure.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment, and wherein:

FIG. 1 illustrates an abbreviated 2 line dot-inversion display panel portion having 4 columns by 8 rows and each column having a red sub pixel, a green sub pixel and a blue sub pixel according to one embodiment of the present invention, wherein FIG. 1A shows the physical display panel sub pixel layout, and FIG. 1B shows its data signal polarity for each sub pixel;

FIG. 9 shows the number of source drivers needed by using different source drivers at various display resolutions of display panels;

DETAILED DESCRIPTION OF THE INVENTION

Figure 2:
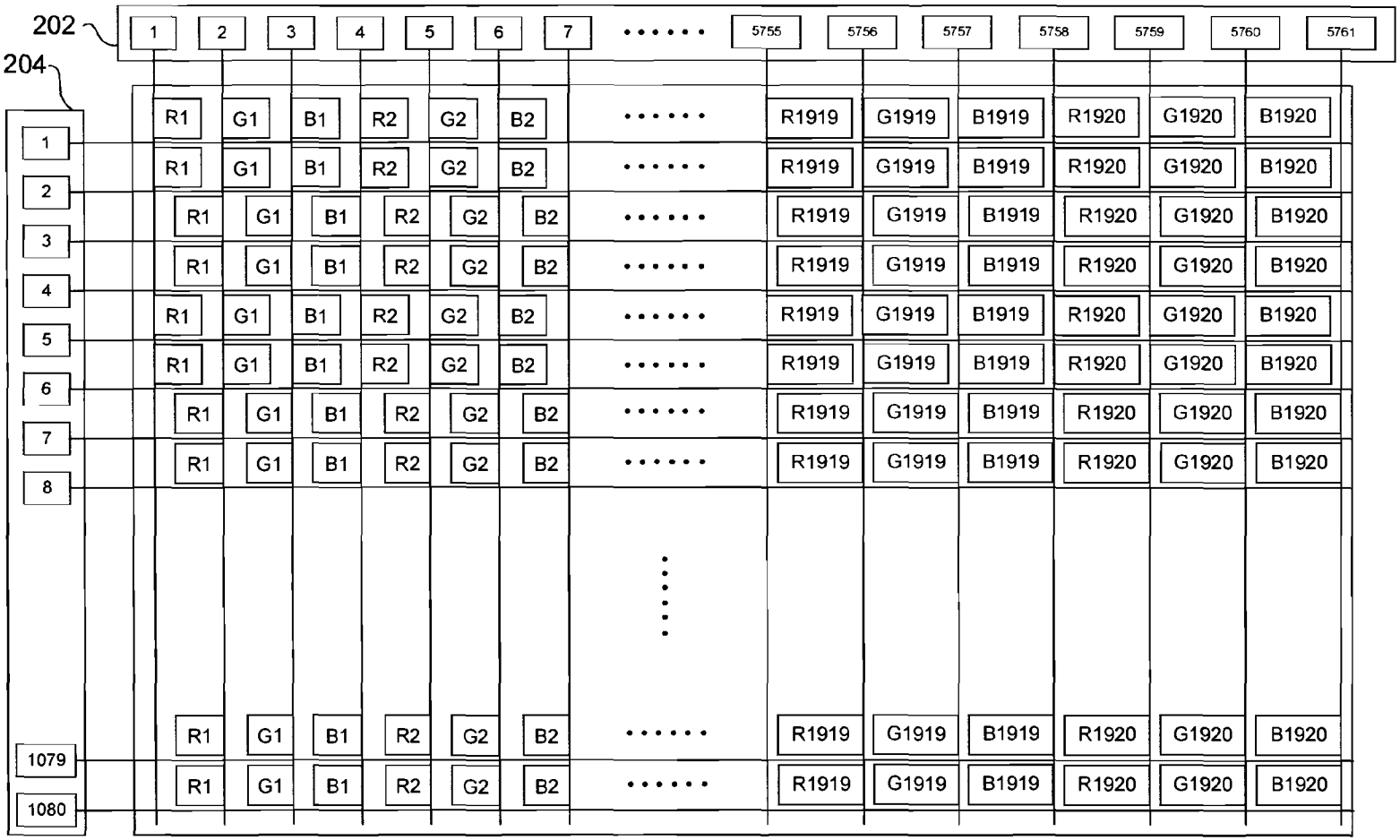
FIG. 2 shows a physical display panel sub pixel layout with one additional data line for a full HD 1080×1920 display panel according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise.

The description will be made as to the embodiments of the present invention in conjunction with the accompanying drawings in FIGS. 1-14. In accordance with the purposes of this invention, as embodied and broadly described herein, this invention relates to a display panel driving circuit for a display panel.

FIG. 1 schematically illustrates an abbreviated, partial 2 line dot-inversion display panel portion having 12 columns by 8 rows forming a matrix according to one embodiment of the present invention. Each column has one of a plurality of red sub pixels, a plurality of green sub pixels, and a plurality of blue sub pixels, each of which is connected to a corresponding data line. Thus, at least 12 data lines are needed. In this embodiment, an additional data line 13 is added such that there are 13 data lines and 8 gate lines. With this additional data line 13, the display panel portion can easily form a two line dot inversion display. FIG. 1A shows the physical display panel sub pixel layout. For a display cell on the i-th column and the first and second rows, i=1, 2, . . . , 12, or subsequent every two other rows, the display cell is always connected to the i-th data line. For a display cell on the i-th column and the third and fourth rows, or subsequent every two other rows, the display cell is always connected to the (i+1)-th data line. Since the neighboring two data lines are connected to different signal polarities, the display panel is thus driven by a two line dot inversion display method. FIG. 1B shows data signal polarity for each sub pixel. With the additional data line and such a display cell connection method, the polarity of the signal alternates every column and every two rows. Therefore, a two line dot inversion display panel is formed by adding an additional data line and connecting alternately to the opposite polarity for neighboring two data lines and for neighboring two gate lines.

In order to put the previous drawing and related disclosure into prospective, FIG. 2 is used to illustrate a physical display panel sub pixel layout with one additional data line for a full HD ("High Definition") 1920×1080 display panel according to one embodiment of the present invention. For a full HD 1920×1080 display panel, there are 1920×1080 display pixels. Each pixel has three sub pixels for expressing a red color, a green color and a blue color. Therefore, there are 1920×3=5760 data lines for vertical display lines 202, and 1080 gate lines for horizontal display lines 204. An additional data line 5761 is used to form a 2 line dot inversion display panel according to the present invention. For the first two gate lines, or the subsequent every other two gate lines, i.e. the (2j+1)-th, and the (2j+2)-th gate lines, where j=0, 2, . . . , 538<1080/2=540, the sub pixels Ri, Gi, Bi, i=1, 2, . . . , 1920 are connected to the (3i−2)-th, the (3i−1)-th, and the (3i)-th data lines, respectively. For the third and fourth gate lines, or the subsequent every other two gate lines, i.e. the (2j+1)-th, and the (2j+2)-th gate lines, where j=1, 3, . . . , <1080/2+1=541, the sub pixels Ri, Gi, Bi, i=1, 2, . . . , 1920 are connected to the (3i−1)-th, the (3i)-th, and the (3i+1)-th data lines, respectively.

In one aspect, thus, the present invention relates to a display panel driving circuit for driving a display panel. The display panel has Y successive gate lines, M+1 successive data lines crossing the Y gate lines forming a plurality of crossing points of the Y gate lines and M+1 data lines, where M and Y are positive integers, and a plurality of display cells. These display cells are positioned at corresponding crossing points of the Y gate lines and M+1 data lines thereby to form a matrix with a plurality of columns {i=1, 2, . . . , M+1}. The display cells within column i positioned at the crossing points of the i-th data line and the (2j+1)-th or (2j+2)-th gate line are connected to the i-th data line, where j=0, 2, 4, . . . , <[Y/2]. The display cells within column i+1 positioned at the crossing points of the (i+1)-th data line and the (2j+1)-th or (2j+2)-th gate line are connected to the (i+1) data line, where j=1, 3, . . . , <[Y/2]+1. The i-th data line and the (i+1)-th data line have opposite data signal polarities, respectively.

Figure 3:
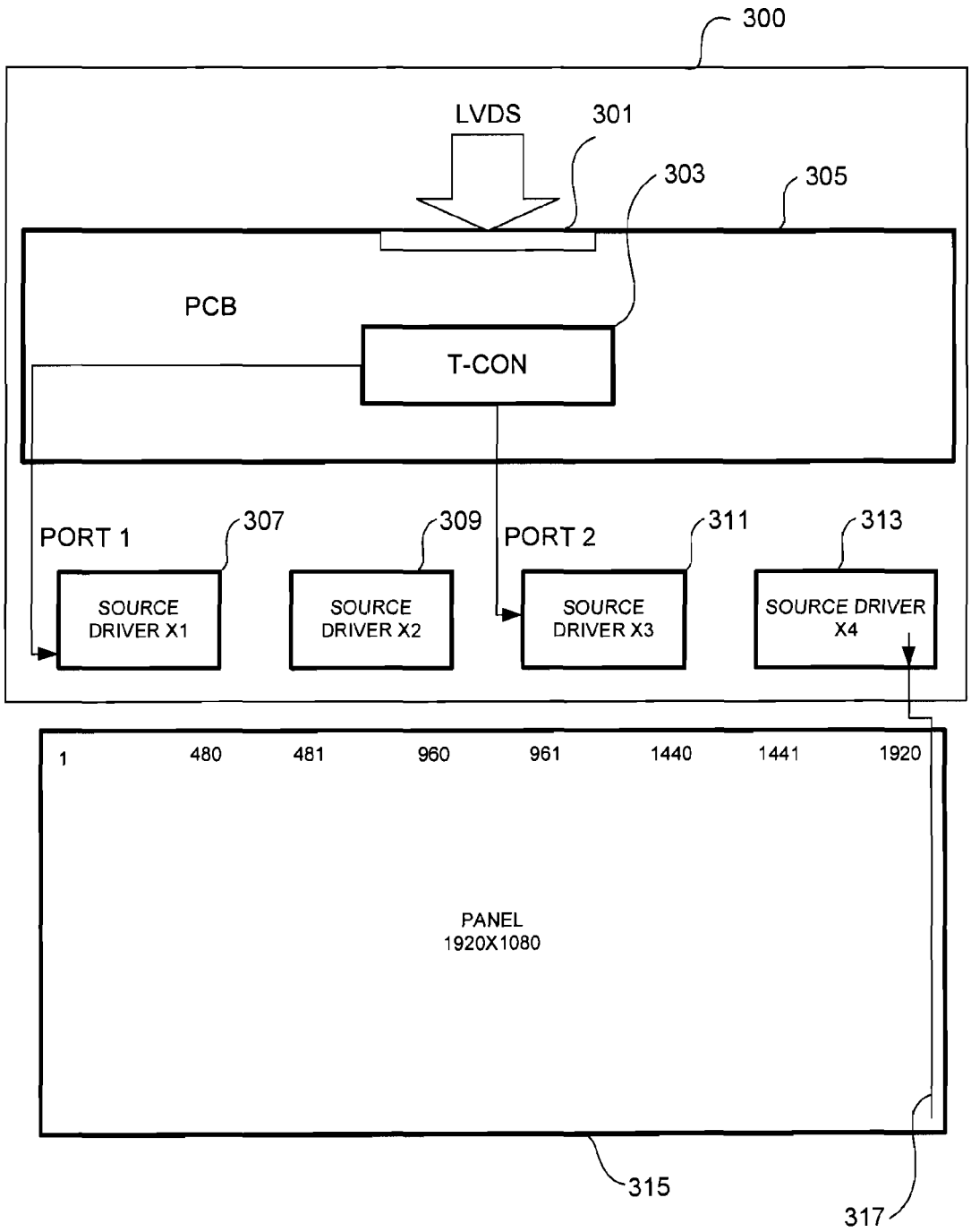
FIG. 3 is a block diagram of a display panel driving circuit for a 1920×1080 display panel according to one embodiment of the present invention.

Referring now to FIG. 3, a block diagram of a display panel driving circuit 300 for a 1920×1080 display panel is shown according to one embodiment of the present invention. The driving circuit 300 is used to drive a 1920×1080 pixel display panel 315, which has 1080×1920 display pixels. In one embodiment, the display panel driving circuit has: (i) a printed circuit board ("PCB"), (ii) an input interface 301 adapted on the PCB 305 to receive input video signal where a low voltage differential signaling (LVDS) communication protocol is used, (iii) a timing controller (T-CON) 303 adapted on the PCB 305 to control timing signal for the display panel 315, (iv) a plurality of first source drivers 307, 309, and 311, and (v) at least one second source driver 313. The plurality of first source drivers 307, 309, and 311 and the at least one second source driver 313 are configured such that each of the plurality of first source drivers 307, 309, and 311 drives N data lines, and the at least one second source driver 313 drives N+1 data lines, where N is a positive integer no greater than M, respectively.

Input data signal is divided into two input ports: PORT 1, and PORT 2 as shown in FIG. 3. PORT 1 is used to transmit data to data lines 1 through 2880 by using the first source driver 307, and 309. The PORT 2 is used to transmit data to data lines 2881 through 5760, by using the first source driver 311, and the second source driver 313. The second source driver 313 provides an additional data line 317 (the 5761-th data line) such that the display panel is formed to be a two line dot inversion display panel as described aforementioned paragraphs.

The display cells within column i positioned at the crossing points of the i-th data line and the (2j+1)-th or (2j+2)-th gate line, where j=0, 2, 4, . . . , <540, and i=1, 2, . . . , 5760, receive data signals from corresponding data lines 1 through 3×1920=5760, respectively. The display cells within the column (i+1) positioned at the crossing points of the (i+1)-th data line and the (2j+1)-th or (2j+2)-th gate line, where j=1, 3, . . . , <540, and i=1, 2, . . . , 5760, receive shifted data signals from the data lines 2 through 5761, respectively.

In one embodiment, the display panel 315 is a liquid crystal display panel, and its display cells comprise liquid crystal cells. The input interface 301 includes an RSDS input interface, or a mini-LVDS input interface.

In one embodiment, each column of the display cells is driven by three sub pixel data lines mapped into a first output channel, a second output channel and a third output channel for expressing a red color, a green color, and a blue color, respectively. When the (2j+1)-th or (2j+2)-th gate line is scanned, where j=1, 3, . . . , <540, an "invalid data" is inserted into the timing controller 303, the sub pixel data is shifted to form the shifted data such that red sub pixel data signal is shifted by one sub pixel and stored in a corresponding green output channel, the green sub pixel data signal is shifted by one sub pixel and stored in a corresponding blue output channel, and blue sub pixel data signal is shifted by one sub pixel and stored in a corresponding red output channel. An "invalid data" is a data signal that is not an input data signal for display but is utilized to shift desired data signals.

Figure 4:
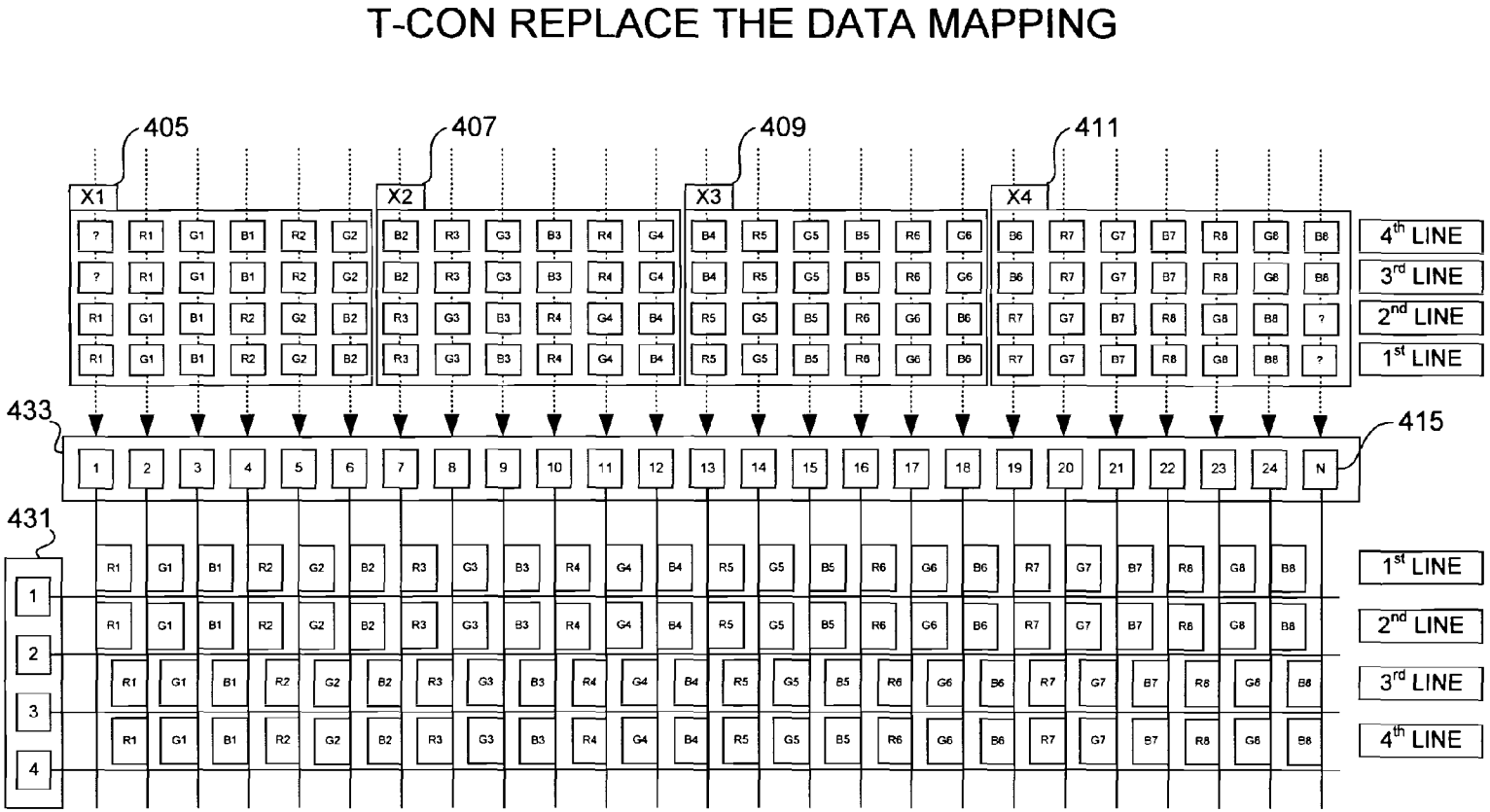
FIG. 4 illustrates how the data mapping is replaced by a timing controller (T-CON) in a display panel driving circuit for a portion of a display panel according to one embodiment of the present invention.

FIG. 4 illustrates how the data mapping is replaced by a timing controller (T-CON) in a display panel driving circuit for a portion of a display panel according to one embodiment of the present invention. The display panel has 4×8 display pixels with 4 rows of horizontal display cells 431 and 25 data lines for 24 columns of vertical display cells 433 in a red color, a green color, and a blue color. The driving circuit includes three first source driver 405, 407, and 409, and one second source driver 411. For the first two gate lines, $1^{st}$ LINE and $2^{nd}$ LINE, the input data signal is transmitted directly without any shifting. The sub pixels R1, G1, B1 are transmitted to the data lines 1, 2, and 3, respectively. The sub pixels R8, G8, B8 are transmitted to the data lines 22, 23, and 24, respectively. For the third and the fourth gate lines, $3^{rd}$ LINE and $4^{th}$ LINE, the input signal is shifted to the right one sub pixel. The sub pixels R1, G1, B1 are transmitted to the data lines 2, 3, and 4, respectively. The sub pixels R8, G8, B8 are transmitted to the data lines 23, 24, and 25, respectively. The sub pixel signals for the first line and the second line at data line N 415 may be random since they are not displayed. The sub pixel signals for the third line and the fourth line at data line 1 may be random since they are not displayed.

Figures 5A, 5B:
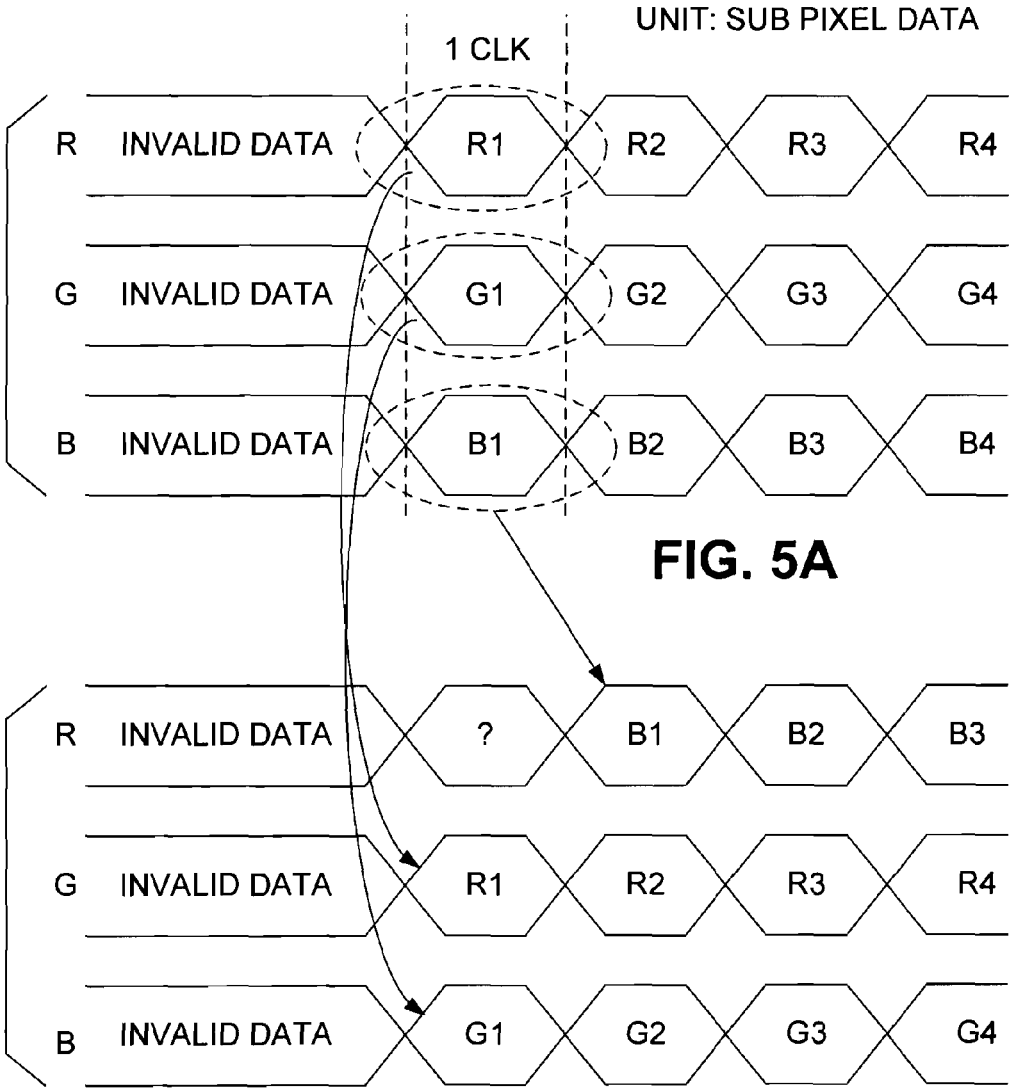
FIGS. 5A-5B illustrates how invalid data are inserted and sub pixel data are shifted according to one embodiment of the present invention.

FIG. 5 illustrates how an invalid data is inserted and sub pixel data is shifted according to one embodiment of the present invention. When the first and the second gate lines are scanned, the data line output is directly mapped to its corresponding output channel as shown in FIG. 5A. They are arranged in the order of R1, G1, B1, R2, G2, B2, . . . , R1920, G1920, and B1920. Data signals R1, G1, B1, . . . , R1920, G1920, and B1920 are mapped to data lines 1, 2, . . . , 5760.

When the third and the fourth gate lines are scanned, the data line output is shifted by the timing controller (T-CON) to the next output channel as shown in FIG. 5B. An "invalid data" is inserted into the time slot where the R1 should be positioned. Therefore, the signals are arranged in the order of the "invalid data", R1, G1, B1, R2, G2, B2, R1920, G1920, and B1920. Because of the additional data line, the invalid data is ignored and R1, G1, B1, . . . , R1920, G1920, and B1920 are mapped to data lines 2, 3, 4, . . . , 5761.

FIG. 6 shows further details of data mapping shown in FIGS. 5A and 5B. In this illustration, there are four source drivers 601, including three first source drivers X1, X2, and X3, and one second source driver X4. There are a total number of 24 output channels and 25 data lines 603 connected to a display panel, including an additional data line N 605.

Figure 6A:
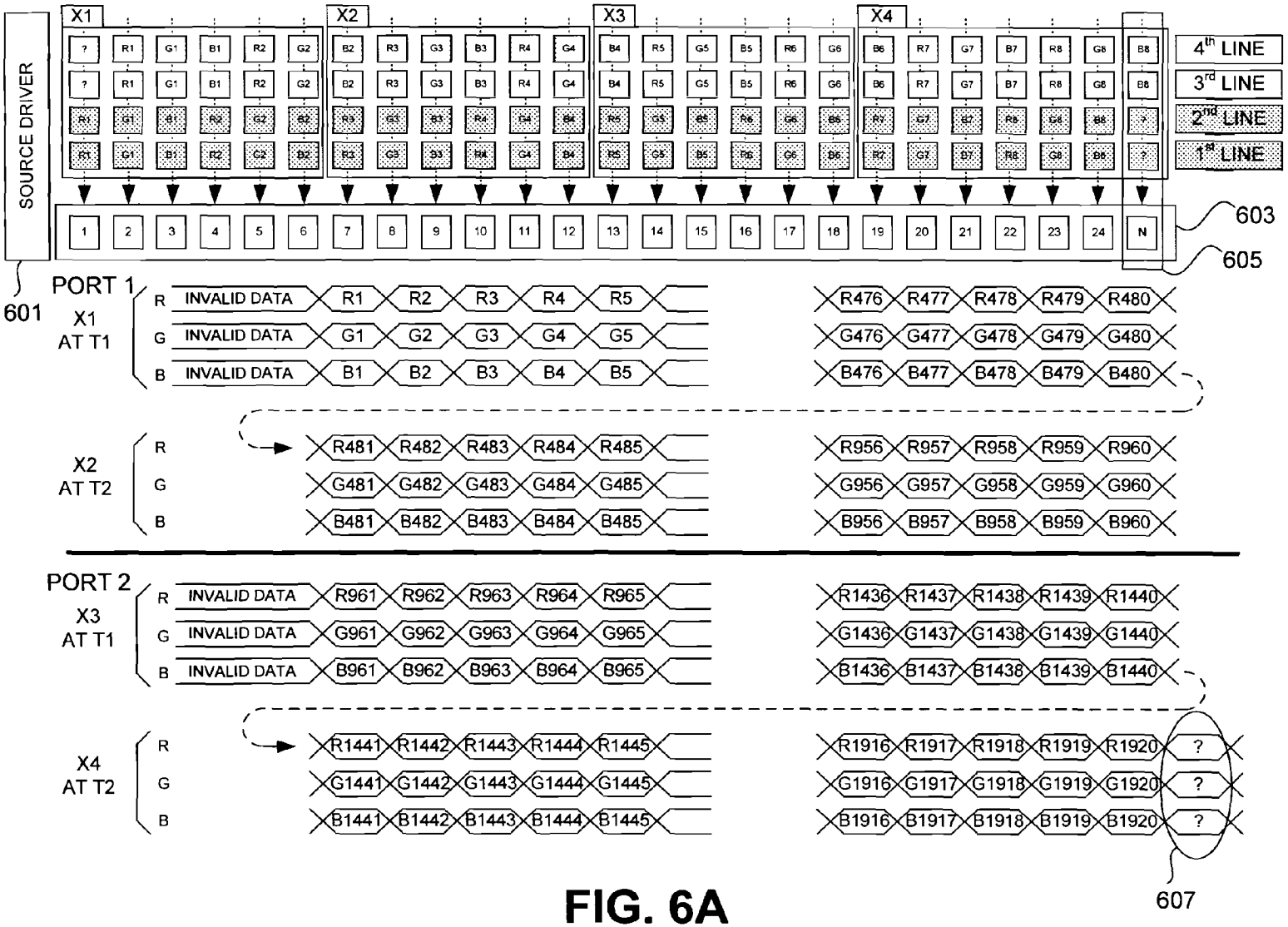
FIG. 6A shows no invalid data are inserted for the first two scan lines and every other two scan lines and FIG. 6B shows invalid data are inserted for the third and fourth scan lines and every other two scan lines, according to one embodiment of the present invention.

As shown in FIG. 6A, for the first two gate lines, or the subsequent every other two gate lines, i.e. the (2j+1)-th, and the (2j+2)-th gate lines, where j=0, 2, . . . , <1080/2, the sub pixel data Ri, Gi, Bi, i=1, 2, . . . , 1920 are mapped to the (3i−2)-th, the (3i−1)-th, and the (3i)-th data lines, respectively. They are arranged in the order of R1, G1, B1, R2, G2, B2, . . . , R1920, G1920, and B1920. Data signals R1, G1, B1, . . . , R1920, G1920, and B1920 are mapped to data lines 1, 2, . . . , 5760. Data slots 607 in FIG. 6A can be random since they are ignored and not displayed.

Figure 6B:
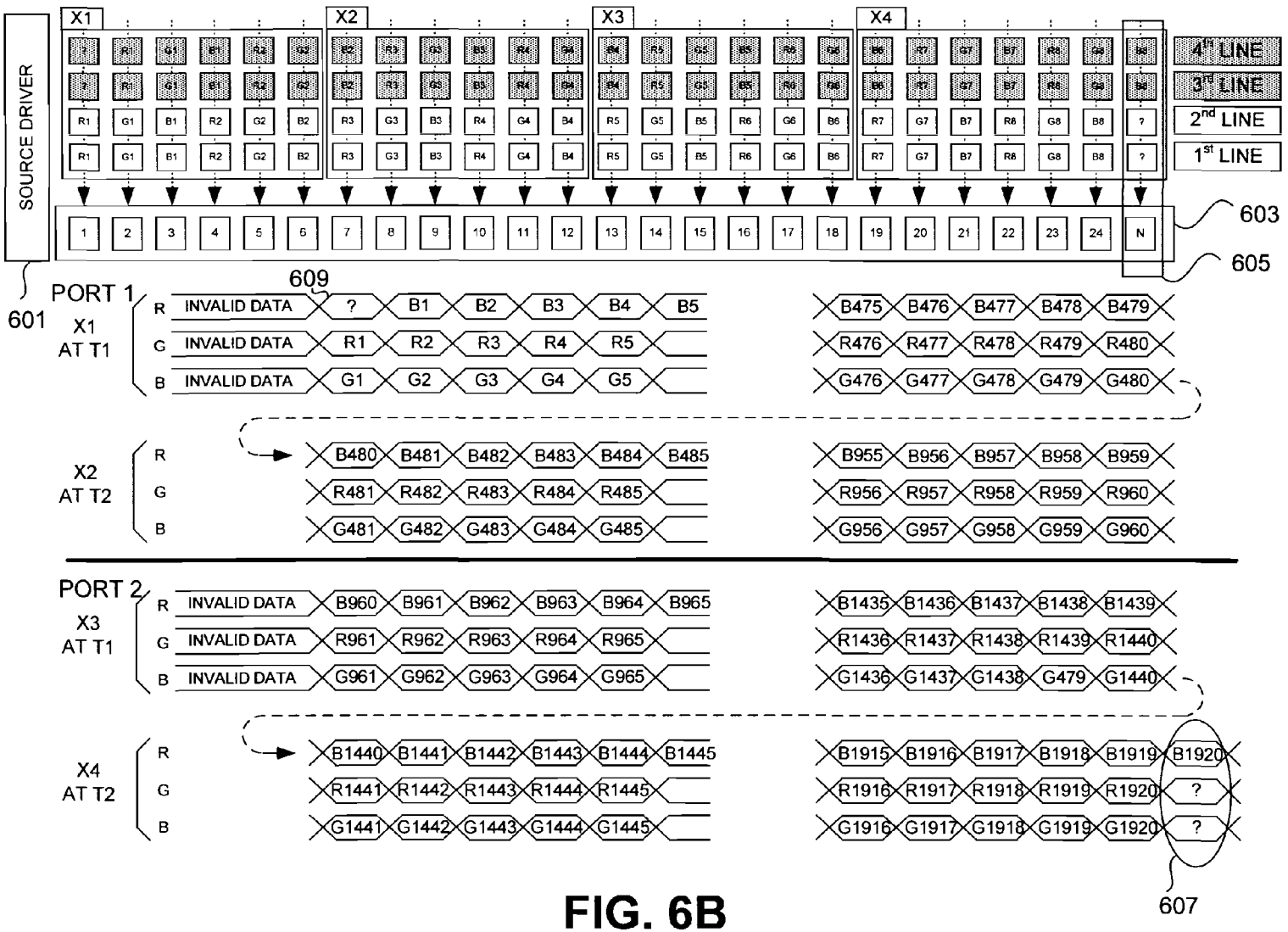

As shown in FIG. 6B, for the third and fourth gate lines, or the subsequent every other two gate lines, i.e. the (2j+1)-th, and the (2j+2)-th gate lines, where j=1, 3, . . . , <1080/2+1, the sub pixels Ri, Gi, Bi, i=1, 2, . . . , 1920 are shifted by the T-CON and mapped to (3i−1)-th, (3i)-th, and (3i+1)-th data lines, respectively. An "invalid data" is inserted into the time slot where the R1 should be positioned. Therefore, the signals are arranged in the order of the "invalid data", R1, G1, B1, R2, G2, B2, . . . , R1920, G1920, and B1920. Because of the additional data line, the invalid data is ignored and R1, G1, B1, . . . , R1920, G1920, and B1920 are mapped to data lines 2, 3, 4, . . . , 5761. The first time slot for data slots 607 in FIG. 6B is mapped to the data line 5761 (the additional data line). The time slot for data 609 in FIG. 6B contains invalid data and it is ignored and will not be displayed.

Figure 7:
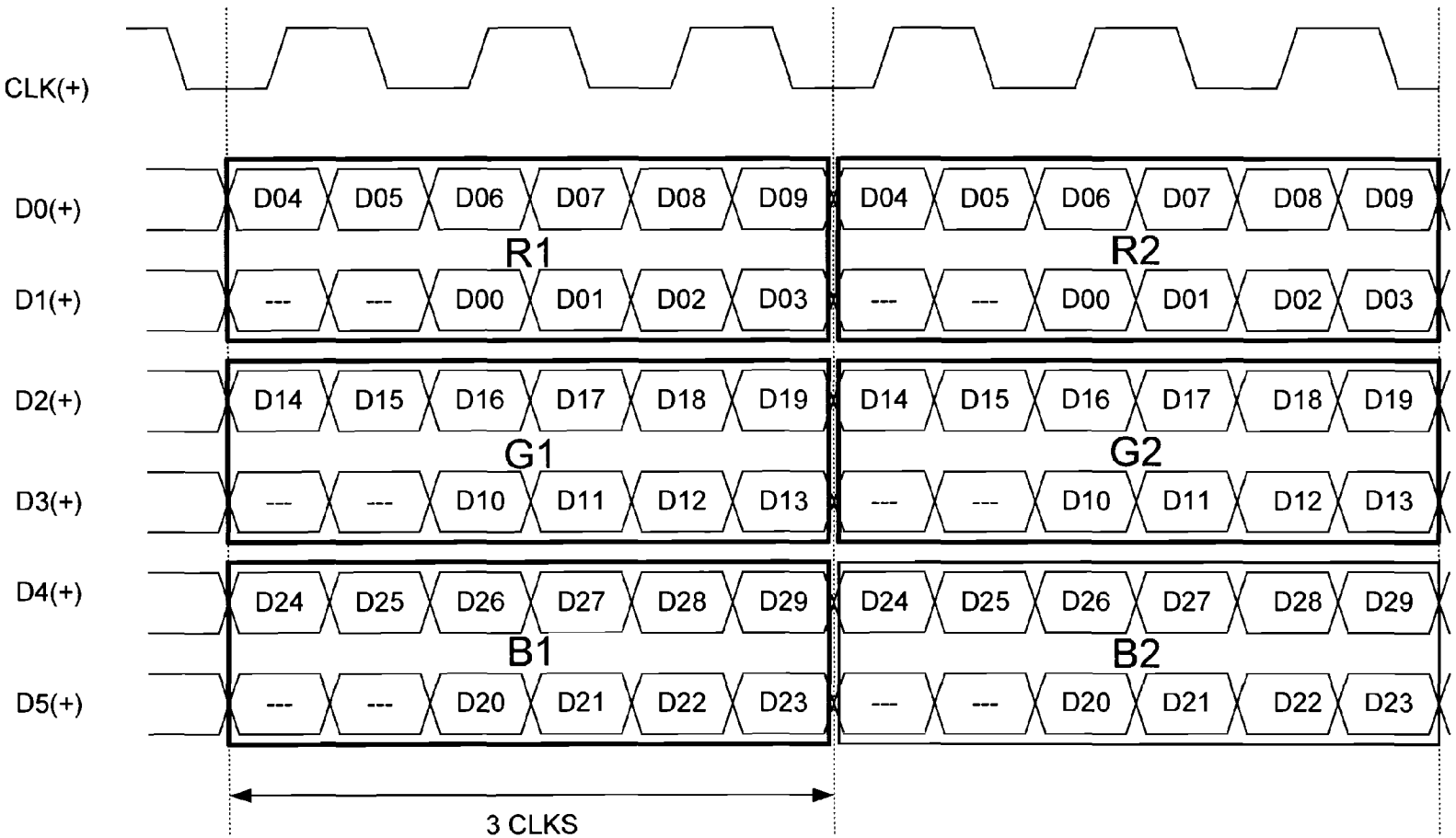
FIG. 7 displays a communication protocol for mini-LVDS digital interface where 10-bit data are transmitted at 6-pair mode according to one embodiment of the present invention.

FIG. 7 displays a communication protocol for mini-LVDS digital interface where 10 bits data is transmitted at 6-pair mode according to embodiment of the present invention. By using this 6 pair transmission protocol, a red color sub pixel R1 is represented by 10 bits D00, D01, . . . , D09, a green color sub pixel G1 is represented by 10 bits D10, D11, . . . , D19, and a blue color sub pixel B1 is represented by 10 bits D20, D21, . . . , D29. In each time slot, there are two bits unused as marked as "---" shown in FIG. 7. There are a total number of 6 data channels D0, D1, D2, D3, D4, and D5, and it takes three clock cycles to transmit data for one set of red, green and blue color sub pixel pixels. The next three sub pixels R2, G2, and B2 are transmitted in similar fashion taking another three clock cycles, and it continues until the completion of transmission of 5760 sub pixel data.

Figure 8A:
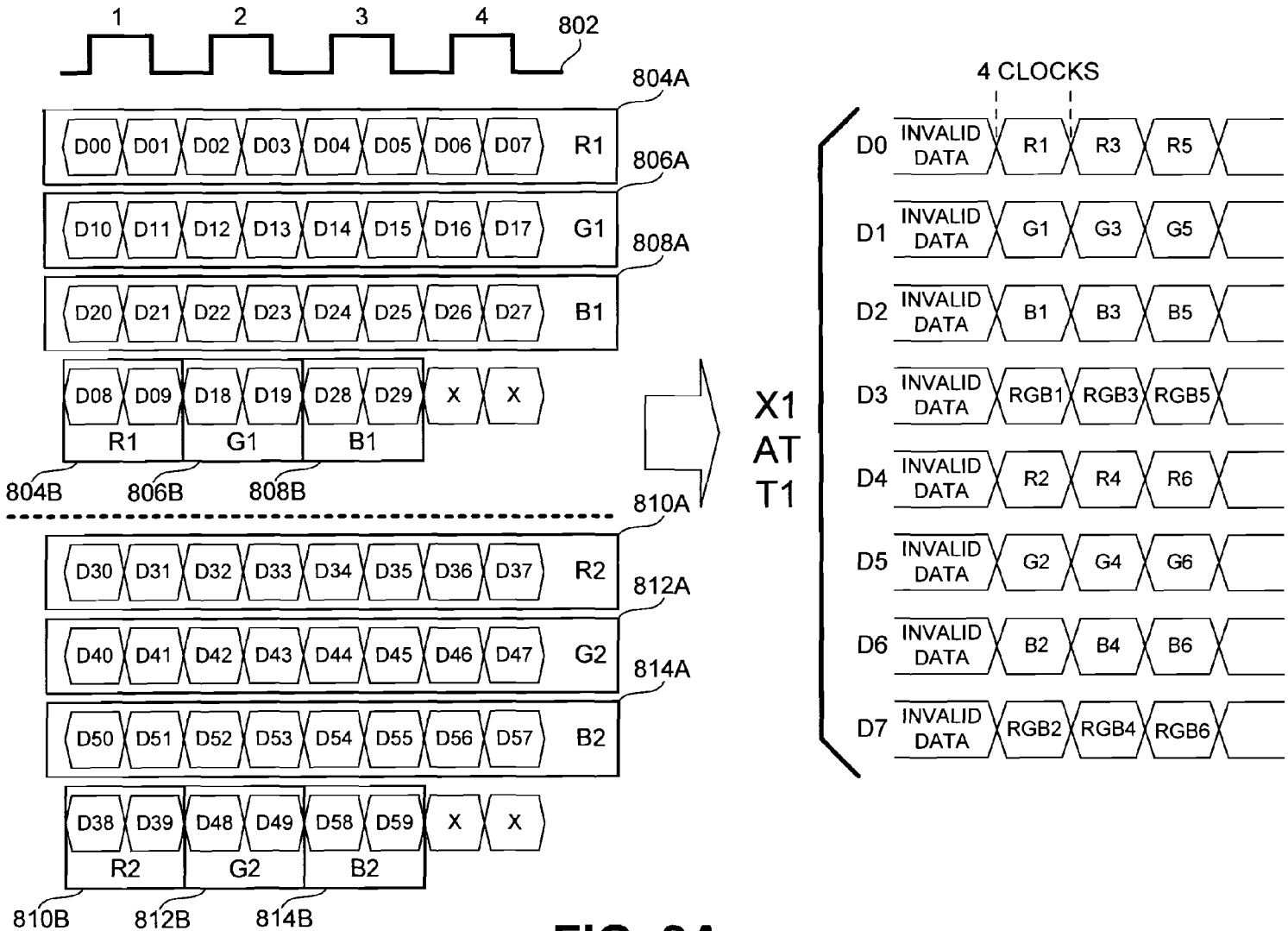
FIG. 8A displays a communication protocol for mini-LVDS digital interface where 10-bit data are transmitted at 8-pair mode, FIG. 8B displays a two port system displays each pixel without shifting for the first two gate lines or every other two gate lines, and FIG. 8C displays a two port system displays each pixel with shifting one sub pixel data line for the third and fourth lines or every other two gate lines according to one embodiment of the present invention.

Referring now to FIG. 8A, a communication protocol for mini-LVDS digital interface where 10 bits data is transmitted at 8-pair mode is shown according to embodiment of the present invention. In FIG. 8A, by using this 8 pair transmission protocol, the first red color sub pixel R1 is represented by 10 bits D00, D01, . . . , D07 (marked as 804A), D08, and D09 (marked as 804B), the first green color sub pixel G1 is represented by 10 bits D10, D11, . . . , D17 (marked as 806A), D18, and D19 (marked as 806B), and the first blue color sub pixel B1 is represented by 10 bits D20, D21, . . . , D27 (marked as 808A), D28, and D29 (marked as 806B). The second red color sub pixel R2 is represented by 10 bits D30, D31, . . . , D37 (marked as 810A), D38, and D39 (marked as 810B), the second green color sub pixel G2 is represented by 10 bits D40, D41, . . . , D47 (marked as 812A), D48, and D49 (marked as 812B), and the second blue color sub pixel B2 is represented by 10 bits D50, D51, . . . , D57 (marked as 814A), D58, and D59 (marked as 814B). There are a total of 8 data channels D0, D1, D2, D3, D4, D5, D6, and D7, and it takes four clock cycles 802 to transmit data for two sets of red, green and blue color sub pixel pixels, R1, G, B1, R2, G2, and B2. The next three sub pixels R2, G2, and B2 are transmitted in similar fashion taking another three clock cycles, and it continues until the completion of transmission of 5760 sub pixel data.

Figure 8B:
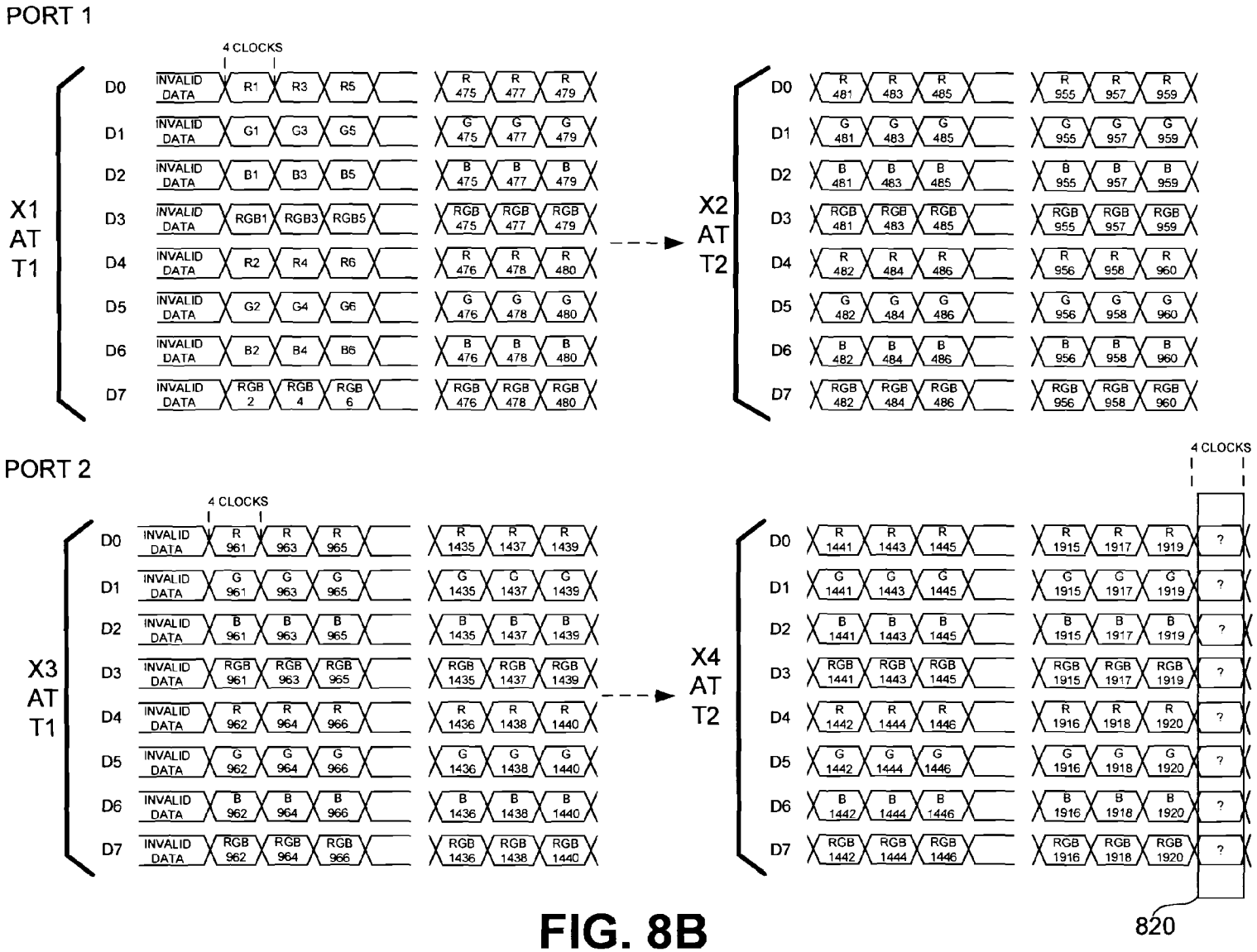
Figure 8C:
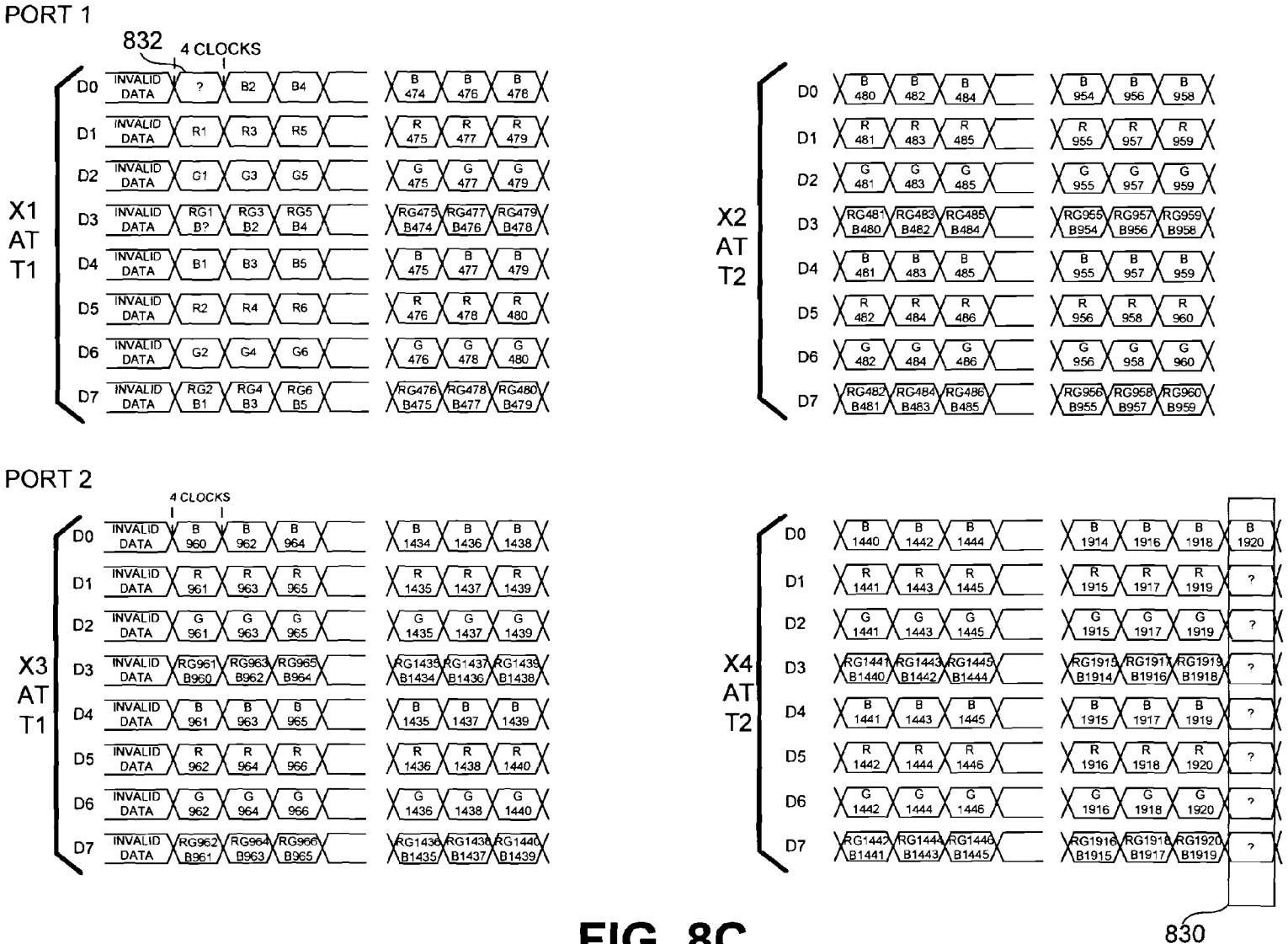

FIGS. 8B and 8C display the data mapping for a two port, four source driver system. As shown in FIG. 8B, for the first two gate lines, or the subsequent every other two gate lines, i.e. the (2j+1)-th, and the (2j+2)-th gate lines, where j=0, 2, . . . , <1080/2, the sub pixel data Ri, Gi, Bi, i=1, 2, . . . , 1920 are mapped to the (3i−2)-th, the (3i−1)-th, and the (3i)-th data lines, respectively. They are arranged in the order of R1, G1, B1, R2, G2, B2, . . . , R1920, G1920, and B1920. Data signals R1, G1, B1, . . . , R1920, G1920, and B1920 are mapped to data lines 1, 2, . . . , 5760. Data slots 607 in FIG. 6A can be random since they are ignored and not displayed. The time slots 820 are ignored and not displayed.

As shown in FIG. 8C, for the third and fourth gate lines, or the subsequent every other two gate lines, i.e. the (2j+1)-th, and (2j+2)-th gate lines, where j=1, 3, . . . , <1080/2+1, the sub pixels Ri, Gi, Bi, i=1, 2, . . . , 1920 are shifted by the T-CON and mapped to the (3i−1)-th, the (3i)-th, and the (3i+1)-th data lines, respectively. An "invalid data" is inserted into the time slot where the R1 should be positioned. Therefore, the signals are arranged in the order of the "invalid data", R1, G1, B1, R2, G2, B2, . . . , R1920, G1920, and B1920. Because of the additional data line, the invalid data is ignored and R1, G1, B1, . . . , R1920, G1920, and B1920 are mapped to data lines 2, 3, 4, . . . , 5761. The last blue sub pixel is represented by B1920 at the first time slot of data slot 830 in FIG. 8C. This data line is mapped to the data line 5761 (the additional data line). The time slot 832 in FIG. 8C contains invalid data and it is ignored and not displayed.

Referring now to FIG. 9, a table summarizing the number of source drivers needed by using different source drivers at various display resolutions of display panels is shown, according to one embodiment of the present invention. There are many manufactures providing various types of source drivers in the market place. One of the important features of source drivers is the number of output channels each source driver has. A few of typical source drivers are shown according to the number of output channels, ranging from 414, through 1026 per source driver, as shown on the second line of the table in FIG. 9. As shown in FIG. 9, the resolution various display formats are:

XGA is 1024×768;
WXGA-1 is 1280×800;
WXGA-2 is 1366×768;
WSXGA is 1440×900;
SXGA is 1280×1024; and
HDTV is 1920×1080.

There are two lines displayed for each required resolution. The first line marked as "REQ" indicates how many source drivers with the resolution listed above are needed for conventional display panels. The second line marked as "UN." indicates the number of unused output channels for the required number of source drivers listed above. For example, for the XGA resolution, 1024×3=3072 data lines are needed and eight of 414 output channel source drivers are required. With this resolution, there are 414×8=3312 output channels available. Since the display panel driving circuit only needs 3072 output channels, there are 240 output channels unused. Therefore, for this display panel with this particular resolution 1024×768, adding an additional output channel (or data line) as implemented embodiments of the present invention described earlier will not require adding a new source driver. Therefore, eight source drivers are needed for this resolution and there are still 240 unused output channels. That means it is not required to add a new source driver if one or more embodiments of the present invention are implemented.

The areas marked as dotted space indicate for that particular resolution and particular type of source driver, it is necessary to add a new source driver if one or more embodiments of the present invention are implemented. For example, for the same XGA resolution 1024×768, 1024×3=3072 data lines are needed and four of 768 output channel source drivers are required. With this resolution, there are 768×4=3072 output channels available. Since the display panel driving circuit needs exactly 3072 output channels, there is no unused output channel. Therefore, for this display panel with this particular resolution 1024×768, adding an additional output channel (or data line) as implemented embodiments of the present invention described earlier will require adding a new source driver.

Of the about 90 combinations of different source drivers and different display resolutions, there are only 14 combinations that require adding a new source driver if the embodiments of the present invention are implemented. They are:

For XGA 1024×768 and the source driver with 768 output channels;
For WXGA 1280×800 and the source drivers with 480, 768, and 960 output channels;
For WSXGA 1440×900 and the source drivers with 432, 480, 540, and 720 output channels;
For SXGA 1280×1024 and the source drivers with 480, 768, and 960 output channels; and
For HDTV 1920×1080 and the source drivers with 480, 576, 720, and 960 output channels.

The table in FIG. 9 shows that it is unlikely that implemented embodiments of the present invention require an additional source driver.

Figure 10:
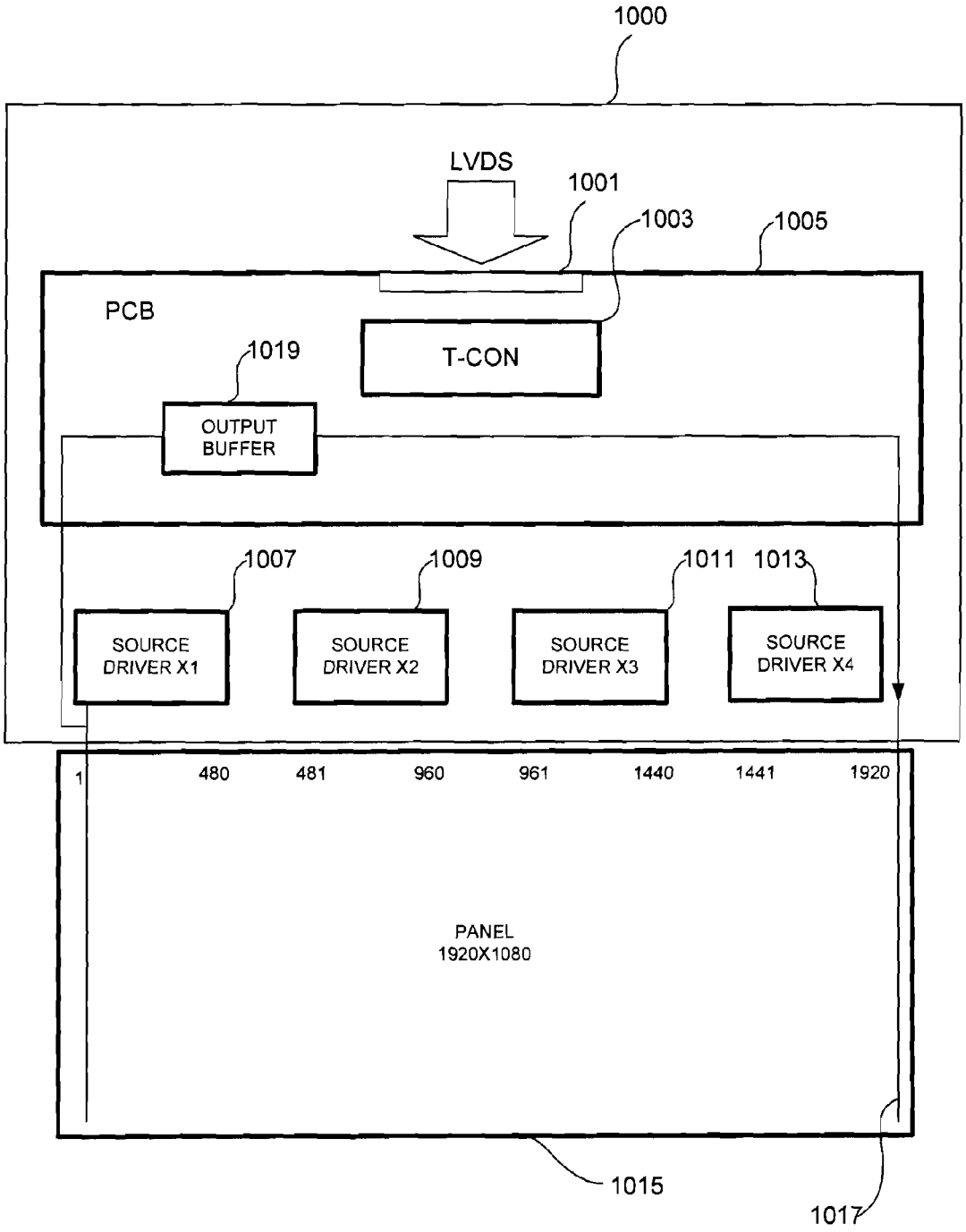
FIG. 10 shows a display panel driving circuit with a timing controller that changes the output data arrangement and an output buffer to drive the additional data line.

In another aspect, the present invention relates to a display panel driving circuit 1000 for driving a display panel. Referring now to FIG. 10, a display panel driving circuit 1000 for a display panel 1015 with a full HDTV resolution 1920×1080 is shown according to one embodiment of the present invention. In one embodiment, the display panel driving circuit 1000 has: (i) a printed circuit board ("PCB") 1005, (ii) an input interface 1001 adapted on the PCB 1005 to receive input video signal where a low voltage differential signaling (LVDS) communication protocol is used, (iii) a timing controller (T-CON) 1003 adapted on the PCB 1005 to control timing signal for the display panel 1015, (iv) an output buffer 1019 for shifting a sub pixel data of the first data line to a sub pixel data of the 5761 data line, and (v) a plurality of source drivers 1007, 1009, 1011 and 1013. Each of the plurality of source drivers 1007, 1009, 1011 and 1013 drives 768 data lines respectively.

The display cells within column i positioned at the crossing points of the i-th data line and the (2j+1)-th or (2j+2)-th gate line, where j=0, 2, 4, . . . , <540, and i=1, 2, . . . 5760, receive data signals from corresponding data lines 1 through M, respectively. The display cells within column (i+1) positioned at the crossing points of the (i+1)-th data line and the (2j+1)-th or (2j+2)-th gate line, where j=1, 3, . . . , <541, and i=1, 2, 5760, receive shifted data signals from the data lines 2 through M+1, respectively.

In one embodiment, the display panel 1015 is a liquid crystal display panel, and its display cells are liquid crystal cells. Each column of the display cells is driven by three sub pixel data lines mapped into a first output channel, a second output channel and a third output channel for expressing a red color, a green color, and a blue color, respectively.

When the (2j+1)-th or (2j+2)-th gate line is scanned, where j=1, 3, . . . , <540, the sub pixel data is shifted to form the shifted sub pixel data such that the first blue sub pixel data is shifted through the output buffer 1019 to the last 5761-th output channel expressing a blue color, the red sub pixel data signal is shifted by one sub pixel and stored in a corresponding green output channel, the green sub pixel data signal is shifted by one sub pixel and stored in a corresponding blue output channel, and the blue sub pixel data signal is shifted by one sub pixel and stored in a corresponding red output channel.

Figure 11A:
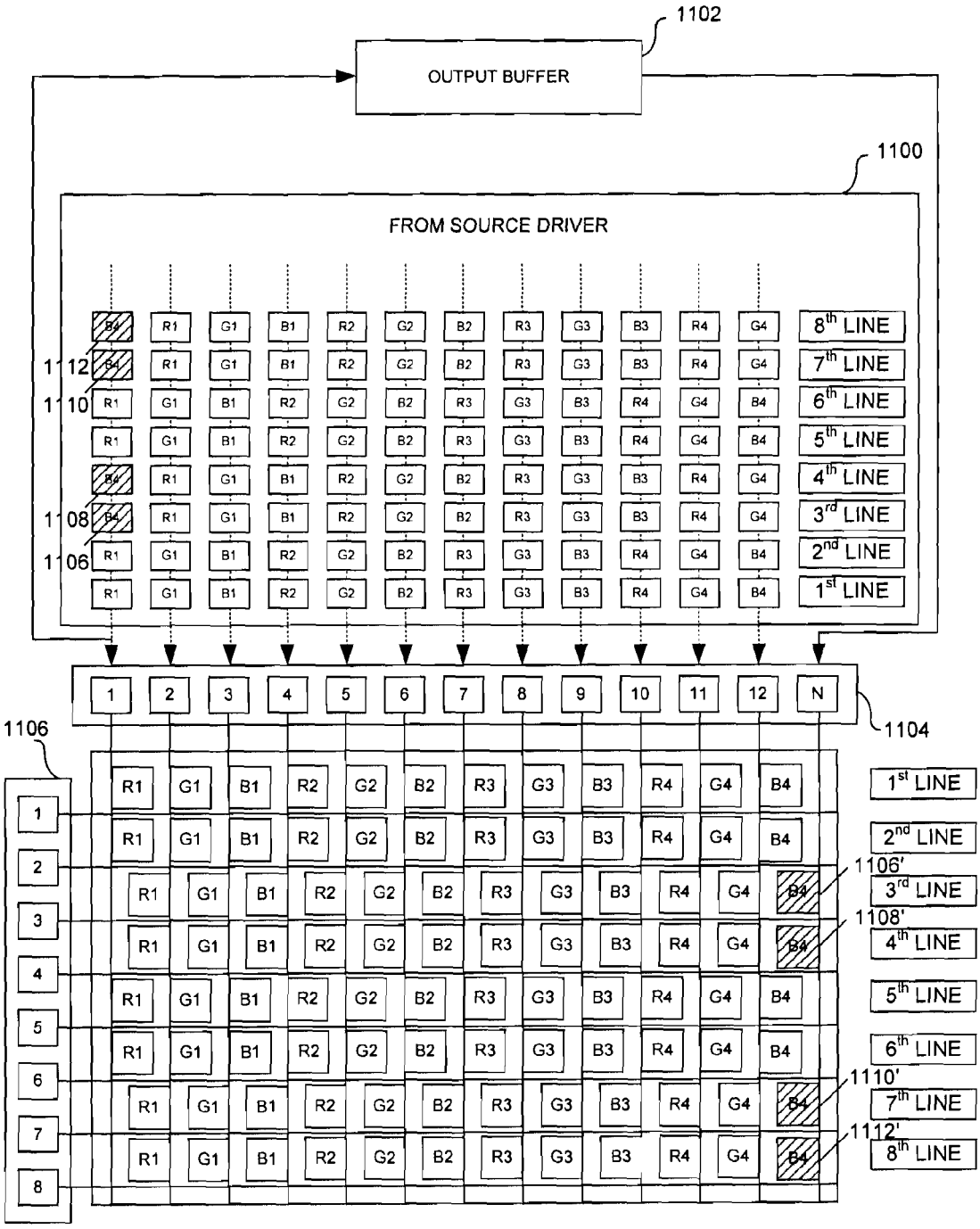
FIG. 11A illustrates how the data signals are transmitted to a portion of a display panel with 12 columns of sub pixel and 13 sub pixel data lines using an output buffer, where there is no shift for the first two gate lines and subsequent every other two gate lines, and the first blue sub pixel data is shifted to the last sub pixel data line through the output buffer, and all other sub pixel data are shift to the next sub pixel for the third, and fourth data lines and subsequent every other two gate lines according to one embodiment of the present invention.

In order to put the previous drawing into prospective, FIG. 11A is used to illustrate a physical display panel sub pixel layout with one additional data line for a driving circuit 1100 for a portion of display panel with 12 columns of sub pixel and 13 sub pixel data lines using an output buffer 1102 according to one embodiment of the present invention. For the display panel, there are 8 rows and 4 columns of display pixels. Each pixel has three sub pixels for expressing a red color, a green color and a blue color. Therefore, there are 12 data lines for vertical display lines 1104, and 8 gate lines 1106 for horizontal display lines. An additional data line 13 is used to form a 2 line dot inversion display panel according to the present invention.

For the first two gate lines, or the subsequent every other two gate lines, i.e. (2j+1)-th, and (2j+2)-th gate lines, where j=0, 1, 2, and 3, the sub pixels Ri, Gi, Bi, i=1, 2, . . . , 4 are connected to (3i−2)-th, (3i−1)-th, and (3i)-th data lines, respectively. There is no shift for these gate lines.

For the third and fourth gate lines, or the subsequent every other two gate lines, i.e. (2j+3)-th, and (2j+4)-th gate lines, where j=0, 1, 2, and 3, the sub pixels Ri, Gi, Bi, i=1, 2, . . . , 4 are connected to (3i−1)-th, (3i)-th, and (3i+1)-th data lines, respectively. A shift to the next data line by using a timing controller and the first data line B4 shown as 1106, 1108, 1110, and 1112 are shifted to the last 13-th data line, shown as 1106', 1108', 1110', and 1112'. For a larger display panel, this arrangement can be expanded to any necessary horizontal and vertical resolution.

Figure 11B:
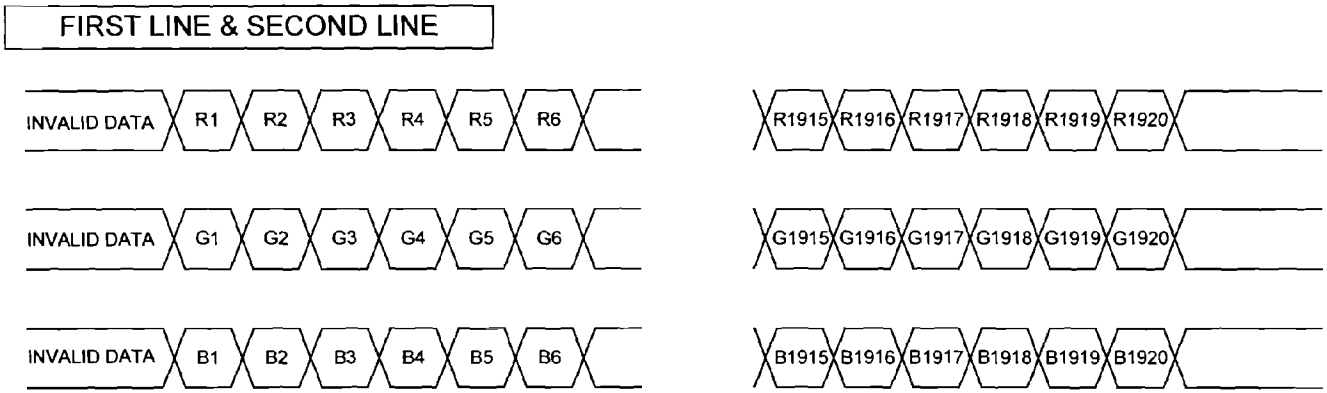
FIG. 11B illustrates that the data signal is not shifted for the first two gate lines and subsequent every other two gate lines.

FIG. 11B illustrates that the data signal is not shifted for the first two gate lines and subsequent every other two gate lines for a full HDTV 1920×1080 display panel according to one embodiment of the present invention. For the first two gate lines, or the subsequent every other two gate lines, i.e. (2j+1)-th, and (2j+2)-th gate lines, where j=0, 1, 2, . . . , <540, the sub pixels Ri, Gi, Bi, i=1, 2, . . . , 1920 are connected to (3i−2)-th, (3i−1)-th, and (3i)-th data lines, respectively. There is no shift for these gate lines.

Figure 11C:
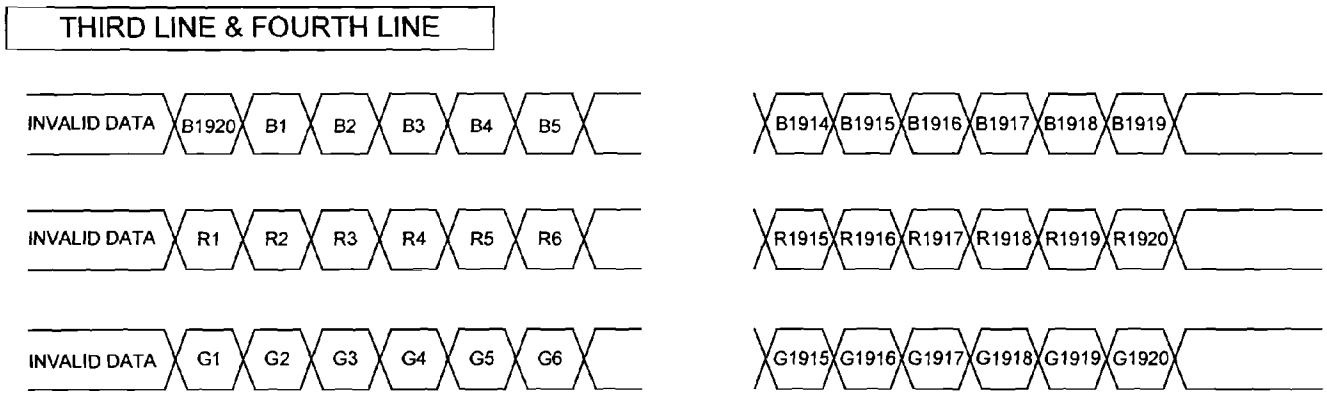
FIG. 11C illustrates how the first sub pixel data is shifted to the last sub pixel data line through the output buffer, and all other sub pixel data are shift to the next sub pixel data for the third, and fourth data lines and subsequent every other two gate lines.

FIG. 11C illustrates how the first sub pixel data is shifted to the last sub pixel data line through the output buffer, and all other sub pixel data are shift to the next sub pixel data for the third, and fourth data lines and subsequent every other two gate lines. For the third and fourth gate lines, or the subsequent every other two gate lines, i.e. (2j+3)-th, and (2j+4)-th gate lines, where j=0, 1, 2, . . . , <540, the sub pixels Ri, Gi, Bi, i=1, 2, . . . , 1920 are connected to (3i−1)-th, (3i)-th, and (3i+1)-th data lines, respectively. The data for red sub pixel R1 is shifted to the data for green sub pixel G1, the data for green sub pixel G1 is shifted to the data for blue sub pixel B1, the data for blue sub pixel B1 is shifted to the data for red sub pixel R2, through the timing controller and the data for last blue sub pixel is shifted to the last 5761-th data line with a output buffer.

In yet another aspect, the present invention relates to a display panel driving circuit for driving a display panel. FIG. 12 illustrates how the data signals are transmitted to a portion of a display panel with 24 columns of sub pixel and 25 sub pixel data lines using a series of switches to select output data, where (A) for the first two gate lines and subsequent every other two gate lines, the sub pixel data lines are transmitted to the output channels when the series switches are in a first position, and (B) for the third, and fourth gate lines and subsequent every other two gate lines, the sub pixel data lines are transmitted to the output channels when the series switches are in a second position, according to one embodiment of the present invention.

Figure 12A:
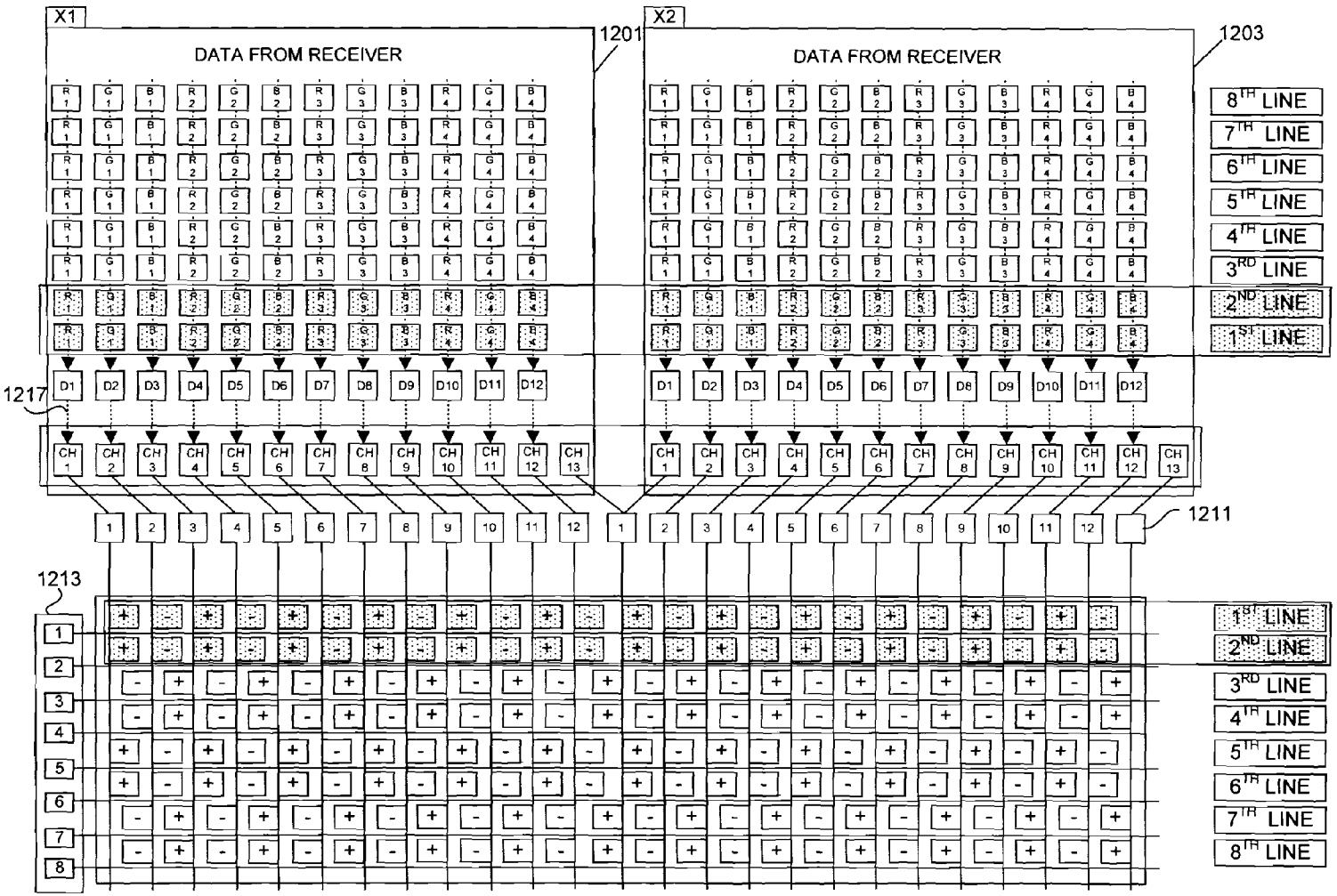
FIGS. 12A-12B illustrates how the data signals are transmitted to a portion of a display panel with 24 columns of sub pixel and 25 sub pixel data lines using a series of switches to select output data, where (A) for the first two gate lines and subsequent every other two gate lines, the sub pixel data lines are transmitted to the output channels when the series switches are in a first position, and (B) for the third, and fourth gate lines and subsequent every other two gate lines, the sub pixel data lines are transmitted to the output channels when the series switches are in a second position, according to one embodiment of the present invention.

In one embodiment, the present invention relates to a display panel driving circuit for driving a display panel. As shown in FIG. 12A, the display panel has 8 successive gate lines, 25 successive data lines crossing the 8 gate lines forming a plurality of crossing points of the 8 gate lines 1213 and 25 data lines, and a plurality of display cells. These display cells are positioned at corresponding crossing points of the 8 gate lines and 25 data lines thereby to form a matrix with a plurality of columns {i=1, 2, . . . , 24}. The display cells within column i positioned at the crossing points of the i-th data line and the (2j+1)-th or (2j+2)-th gate line are connected to the i-th data line, where j=0, 2, 4, . . . , 10<12. The display cells within column i+1 positioned at the crossing points of the (i+1)-th data line and the (2j+1)-th or (2j+2)-th gate line are connected to the (i+1) data line, where j=1, 3, . . . , 11<12+1=13. The i-th data line and the (i+1)-th data line have opposite data signal polarities, respectively. In one embodiment, the display panel driving circuit has: (i) a printed circuit board ("PCB"), (ii) an input interface adapted on the PCB to receive input video signal, (iii) a timing controller adapted on the PCB to control timing signal for the display panel, and (iv) 2 source drivers 1201 and 1203 each coupled to the input interface, wherein each of 12 source drivers has 12 input data lines, 13 output data channels, and (v) a set of switches 1217 to switch the 12 input data lines to 13 output data channels.

The display cells within column i positioned at the crossing points of the i-th data line and the (2j+1)-th or (2j+2)-th gate line, where j=0, and 2, and i=1, 2, . . . , 24, receive data signals from corresponding data lines 1 through 24, respectively. The display cells within column (i+1) positioned at the crossing points of the (i+1)-th data line and the (2j+1)-th or (2j+2)-th gate line, where j=1, and 3, and i=1, 2, . . . , 24, receive switched data signals from the data lines 2 through 25, respectively.

The display panel is a liquid crystal display panel, and its display cells are liquid crystal cells. Each column of the display cells is driven by three sub pixel data lines mapped into a first output channel, a second output channel and a third output channel for expressing a red color, a green color, and a blue color, respectively. When the (2j+1)-th gate line or (2j+2)-th gate line is scanned, where j=0, 2, the output data channels 1 through 12 of each of the K source drivers receive data signals from a first input data line through the 12-th input data line, and the 13-th output data channel CH 13 becomes a floating output data channel.

Figure 12B:
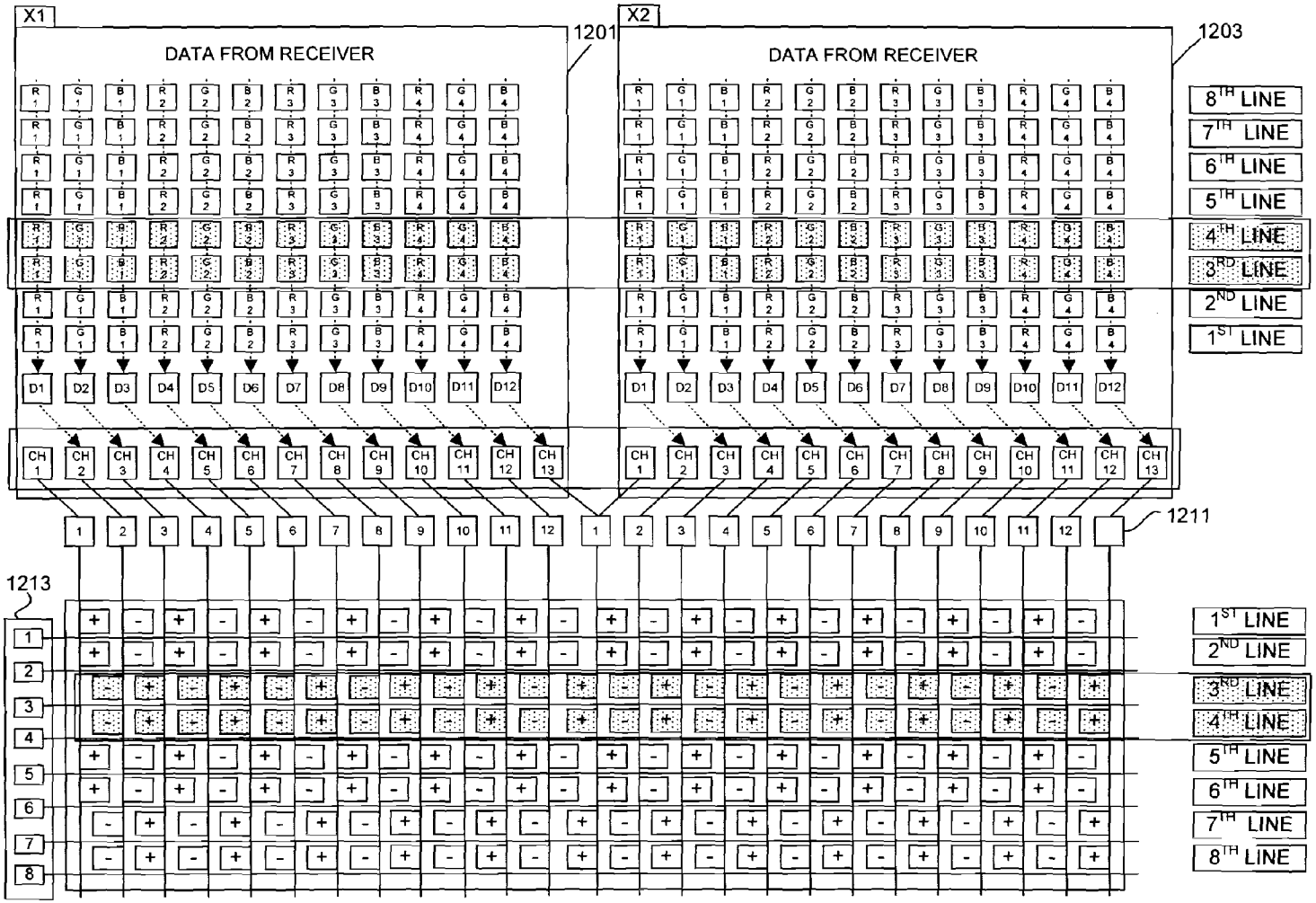

Referring now to FIG. 12B, when (2j+1)-th gate line or (2j+2)-th gate line 1213 is scanned, where j=1, and 3, output data channels 2 though 13 of each of the K source drivers 1201 receive data signals from the first input data channel through the 12-th input data channel, and the first output data channel CH 1 becomes a floating output data channel. The first output channel of the second source driver 1203 is connected to the last output data channel of the first source driver 1201. The output channel CH 13 of the last source driver 1203 is connected to the additional date line 1211.

In an additional aspect, the present invention relates to a display panel driving circuit for driving a display panel. In one embodiment, the display panel driving circuit has: (i) a printed circuit board ("PCB"), (ii) an input interface adapted on the PCB to receive input video signal, (iii) a timing controller adapted on the PCB to control timing signal for the display panel, wherein the timing controller has M T-CON output channels, (iv) a plurality of output channels for driving the plurality of display cells, and (v) a plurality of driver data latches adapted on the PCB, wherein each of the plurality of driver data latches has one output data channel. The display cells within column i positioned at the crossing points of the ith data line and the (2j+1)-th or (2j+2)-th gate line, where j=0, 2, 4, . . . , <[Y/2], and i=1, 2, . . . , M, receive data signals from the T-CON output channels 1 through M, respectively. The display cells within column (i+1) positioned at the crossing points of the i+1th data line and the (2j+1)-th or (2j+2)-th gate line, where j=1, 3, . . . , <[Y/2]+1, and i=1, 2, . . . , M, receive shifted data signals from the T-CON output channels 2 through M+1, respectively.

In one embodiment, the display panel is a liquid crystal display panel, and its display cells are liquid crystal cells. Each column of the display cells is driven by three sub pixel data lines mapped into a first output channel, a second output channel and a third output channel for expressing a red color, a green color, and a blue color, respectively.

Figure 13B:
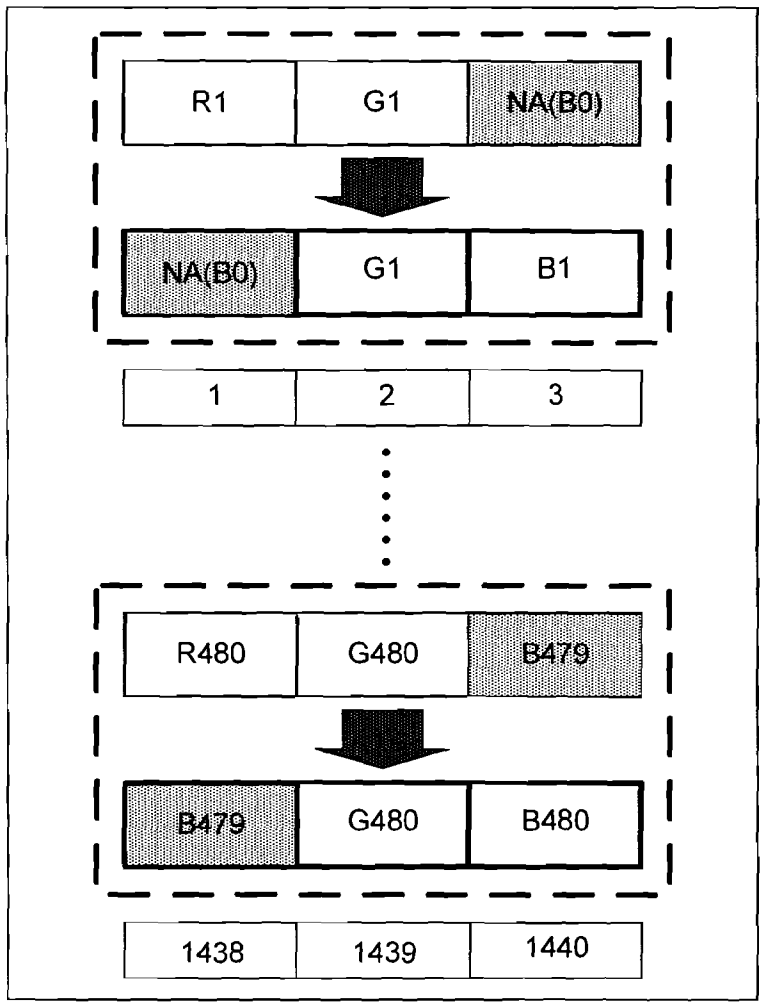
FIGS. 13A-13B illustrates how the data signals are transmitted to output channels for a RSDS interface, where for the first two gate lines and subsequent every other two gate lines, the sub pixel data lines are transmitted to the output channels without any data shifting, and for the third, and fourth gate lines and subsequent every other two gate lines, every blue sub pixel data lines are shifting by one sub pixel by timing controller, according to one embodiment of the present invention.
Figure 13A:
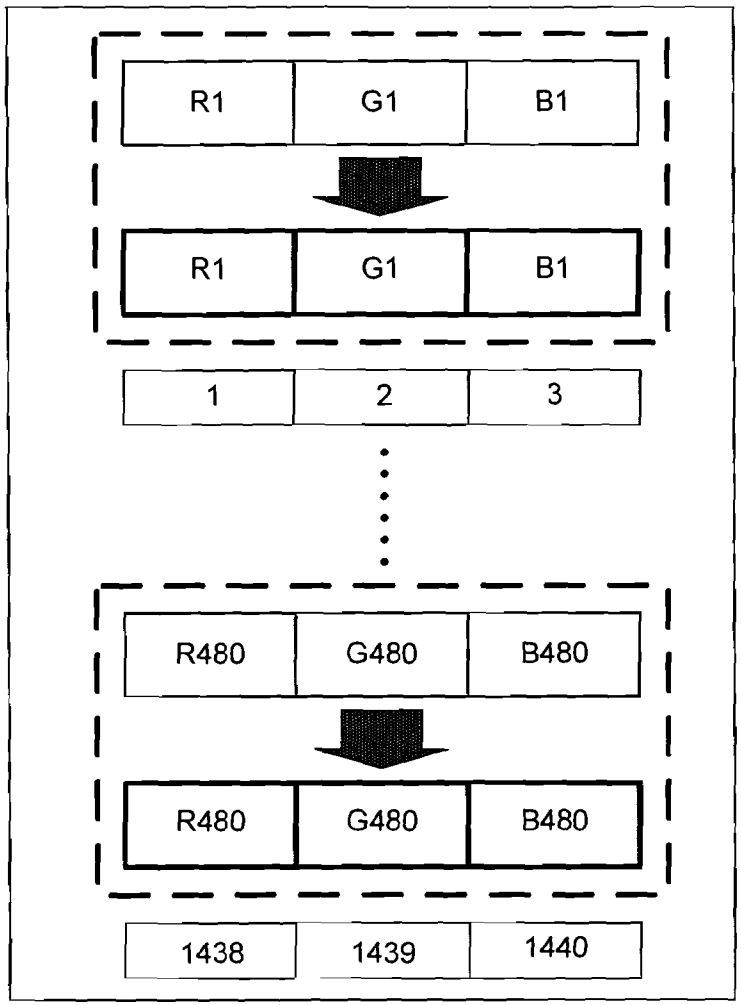

In one embodiment, the display panel driving circuit further includes a RSDS input interface. FIG. 13 illustrates how the data signals are transmitted to output channels for a RSDS input interface and a display panel with horizontal resolution of 480. For the RSDS input interface, when the (2j+1)-th or (2j+2)-th gate line, where j=0, 2, 4, . . . , <[Y/2], is scanned, the driver data latches 1 through 480 receive the data signal from T-CON output channels 1 though 480, as shown in FIG. 13A.

When the (2j+1)-th or (2j+2)-th gate line, where j=1, 3, . . . , <[Y/2]+1, is scanned, the driver data latches 1 through 480 receive the data signal from T-CON output channels 1 though 480, and every even blue sub pixel data line is shifting byl-sub-pixel data by timing controller. In FIG. 13 (B), timing controller sends 1-pixel-shifted blue data (ex. B0) to replace original blue data (ex. B1), and source drivers rearrange input data to every 3 output channels. For example, source drivers rearrange input data (R1, G1, B0) to output channels (B0, R1, G1).

Figure 14B:
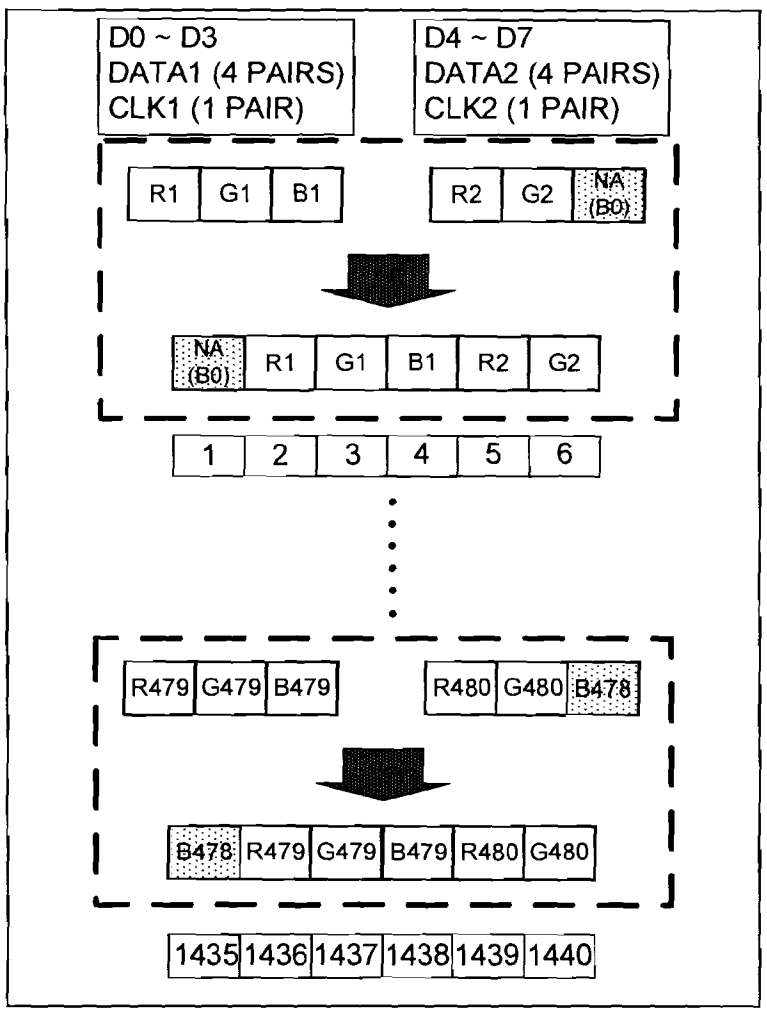
FIGS. 14A-14B illustrates how the data signals are transmitted to output channels for a mini-LVDS interface, where for the first two gate lines and subsequent every other two gate lines, the sub pixel data lines are transmitted to the output channels without any data shifting, and for the third, and fourth gate lines and subsequent every other two gate lines, every even numbered blue sub pixel data lines are shifted by two sub pixel by timing controller, according to one embodiment of the present invention.
Figure 14A:
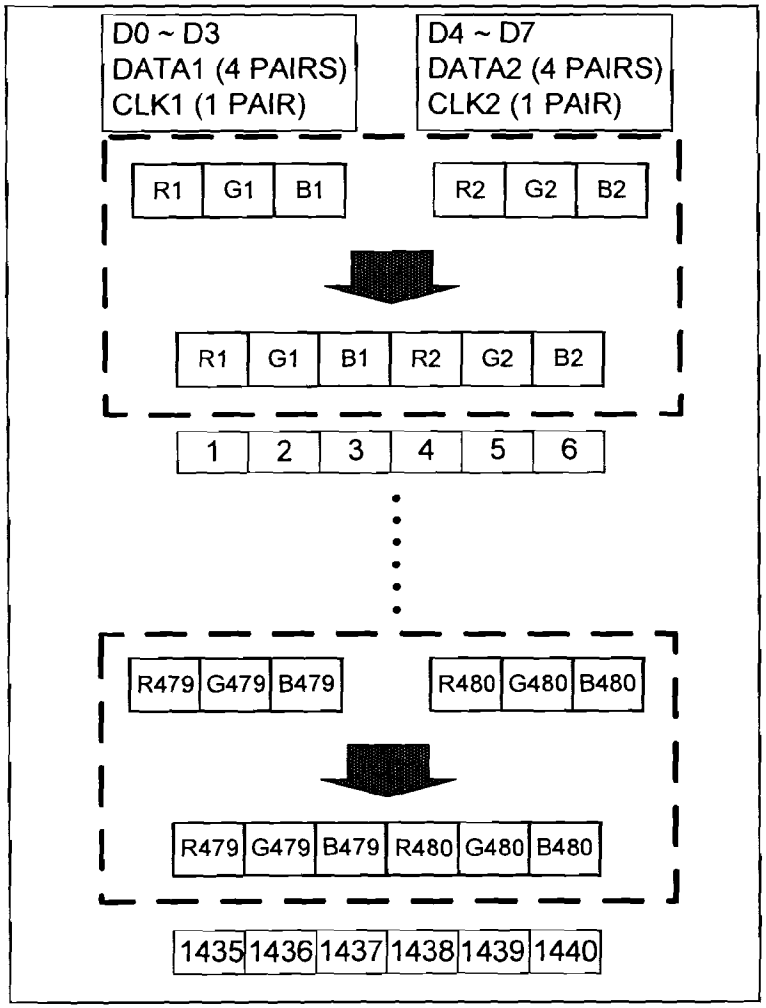

In one embodiment, the display panel driving circuit further includes a Mini-LVDS input interface. FIG. 14 illustrates how the data signals are transmitted to output channels for a Mini-LVDS input interface and a display panel with horizontal resolution of 480. For the Mini-LVDS input interface, when the (2j+1)-th or (2j+2)-th gate line, where j=0, 2, 4, . . . , <[Y/2], is scanned, the driver data latches 1 through 480 receive the data signal from T-CON output channels 1 though 480, as shown in FIG. 14A.

When the (2j+1)-th or (2j+2)-th gate line, where j=1, 3, . . . , <[Y/2]+1, is scanned, the driver data latches 1 through 480 receive the data signal from T-CON output channels 1 though 480, and every even numbered blue sub pixel data line is shifting by two sub pixels by timing controller In FIG. 14 (B), timing controller sends 2-pixel-shifted blue data (ex. B0) to replace original blue data (ex. B2), and source drivers rearrange input data to every 6 output channels. For example, source drivers rearrange input data (R1, G1, B1, R2, G2, B0) to output channels (B0, R1, G1, B1, R2, G2).

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to enable others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A display panel driving circuit for driving a display panel, where the display panel has Y successive gate lines, M+1 successive data lines crossing the Y gate lines forming a plurality of crossing points of the Y gate lines and M+1 data lines, where M and Y are positive integers, and a plurality of display cells, wherein the plurality of display cells are positioned at corresponding crossing points of the Y gate lines and M+1 data lines thereby to form a matrix with a plurality of columns {i=1, 2, . . . , M+1}, wherein display cells within column i positioned at the crossing points of the i-th data line and the (2j+1)-th or (2j+2)-th gate line are connected to the i-th data line, where j=0, 2, 4, . . . , <[Y/2], and display cells within column i+1 positioned at the crossing points of the (i+1)-th data line and the (2j+1)-th or (2j+2)-th gate line are connected to the (i+1)-th data line, where j=1, 3, . . . , <[Y/2]+1, and wherein the i-th data line and the (i+1)-th data line have opposite data signal polarities, respectively, comprising:

(i) a printed circuit board ("PCB");

(ii) an input interface adapted on the PCB to receive input video signal;

(iii) a timing controller adapted on the PCB to control timing signal for the display panel;

(iv) a plurality of first source drivers; and (v) at least one second source driver, wherein the plurality of first source drivers and the at least one second source driver are configured such that each of the plurality of first source drivers has N outputs to respectively drive N data lines, and the at least one second source driver had N+1 outputs to respectively drive N+1 data lines, where N is a positive integer no greater than M, wherein each of the M+1 data lines is driven by a respective, single source driver of the plurality of first source drivers and the at least one second source driver, and wherein the display cells within column i positioned at the crossing points of the i-th data line and the (2j+1)-th or (2j+2)-th gate line, where j=0, 2, 4, . . . , <[Y/2], and i=1, 2, . . . , M, receive data signals from corresponding data lines 1 through M, respectively, and the display cells within column (i+1) positioned at the crossing points of the (i+1)-th data line and the (2j+1)-th or (2j+2)-th gate line, where j=1, 3, . . . , <[Y/2]+1, and i=1, 2, . . . , M, receive shifted data signals from the data lines 2 through M+1, respectively.

2. The display panel driving circuit of claim 1, wherein the display panel comprises a liquid crystal display panel, and wherein the display cells comprise liquid crystal cells.

3. The display panel driving circuit of claim 1, wherein the input interface comprises an RSDS input interface, and a Mini-LVDS input interface.

4. The display panel driving circuit of claim 1, wherein each column of the display cells is driven by three sub pixel data lines mapped into a first output channel, a second output channel and a third output channel for expressing a red color, a green color, and a blue color, respectively.

5. The display panel driving circuit of claim 4, wherein when the (2j+1)-th or (2j+2)-th gate line is scanned, where j=1, 3, . . . , <[Y/2]+1, an "invalid data" is inserted into the timing controller, the sub pixel data is shifted to form the shifted data such that the red sub pixel data signal is shifted by one sub pixel and stored in a corresponding green output channel, the green sub pixel data signal is shifted by one sub pixel and stored in a corresponding blue output channel, and the blue sub pixel data signal is shifted by one sub pixel and stored in a corresponding red output channel.

6. A display panel driving circuit for driving a display panel, where the display panel has Y successive gate lines, M+1 successive data lines crossing the Y gate lines forming a plurality of crossing points of the Y gate lines and M+1 data lines, where M and Y are positive integers, and a plurality of display cells, wherein the plurality of display cells are positioned at corresponding crossing points of the Y gate lines and M+1 data lines thereby to form a matrix with a plurality of columns {i=1, 2, . . . , M+1}, wherein display cells within column i positioned at the crossing points of the i-th data line and the (2j+1)-th or (2j+2)-th gate line are connected to the i-th data line, where j=0, 2, 4, . . . , <[Y/2], and display cells within column i+1 positioned at the crossing points of the (i+1)-th data line and the (2j+1)-th or (2j+2)-th gate line are connected to the (i+1)-th data line, where j=1, 3, . . . , <[Y/2]+1, and wherein the i-th data line and the (i+1)-th data line have opposite data signal polarities, respectively, comprising:

(i) a printed circuit board ("PCB");

(ii) an input interface adapted on the PCB to receive input video signal;

(iii) a timing controller adapted on the PCB to control timing signal for the display panel;

(iv) an output buffer electrically coupled to the first data line and the (M+1)-th data line for shifting a sub pixel data of the first data line to a sub pixel data of the (M+1 )-th data line; and (v) a plurality of source drivers, wherein each of the plurality of source drivers has N outputs to respectively drive N data lines, where N is a positive integer no greater than M, wherein each of the M+1 data lines is driven by a respective, single source driver of the plurality of source drivers, wherein the display cells within column i positioned at the crossing points of the i-th data line and the (2j+1)-th or (2j+2)-th gate line, where j=0, 2, 4, . . . , <[Y/2], and i=1, 2, . . . , M, receive data signals from corresponding data lines 1 through M, respectively, and the display cells within column (i+1) positioned at the crossing points of the (i+1)-th data line and the (2j+1)-th or (2j+2)-th gate line, where j=1, 3, . . . , <[Y/2]+1, and i=1, 2, . . . , M, receive shifted data signals from the data lines 2 through M+1, respectively.

7. The display panel driving circuit of claim 6, wherein the display panel comprises a liquid crystal display panel, and wherein the display cells comprise liquid crystal cells.

8. The display panel driving circuit of claim 6, wherein each column of the display cells is driven by three sub pixel data lines mapped into a first output channel, a second output channel and a third output channel for expressing a red color, a green color, and a blue color, respectively.

9. The display panel driving circuit of claim 8, wherein when the (2j+1)-th or (2j+2)-th gate line is scanned, where j=1, 3, . . . , <[Y/2]+1, the sub pixel data is shifted to form the shifted sub pixel data such that the first blue sub pixel data signal is shifted through the output buffer to the last (M+1 )-th output channel expressing a blue color, the red sub pixel data signal is shifted by one sub pixel and stored in a corresponding green output channel, the green sub pixel data signal is shifted by one sub pixel and stored in a corresponding blue output channel, and the blue sub pixel data signal is shifted by one sub pixel and stored in a corresponding red output channel.

10. A display panel driving circuit for driving a display panel, where the display panel has Y successive gate lines, M+1 successive data lines crossing the Y gate lines forming a plurality of crossing points of the Y gate lines and M+1 data lines, where M and Y are positive integers, and a plurality of display cells, wherein the plurality of display cells are positioned at corresponding crossing points of the Y gate lines and M+1 data lines thereby to form a matrix with a plurality of columns {i=1, 2, . . . , M+1}, wherein display cells within column i positioned at the crossing points of the i-th data line and the (2j+1)-th or (2j+2)-th gate line are connected to the i-th data line, where j=0, 2, 4, . . . , <[Y/2], and display cells within column i+1 positioned at the crossing points of the (i+1)-th data line and the (2j+1)-th or (2j+2)-th gate line are connected to the (i+1)-th data line, where j=1, 3, . . . , <[Y/2]+1, and wherein the i-th data line and the (i+1)-th data line have opposite data signal polarities, respectively, comprising:

(i) a printed circuit board ("PCB");

(ii) an input interface adapted on the PCB to receive input video signal;

(iii) a timing controller adapted on the PCB to control timing signal for the display panel; and (iv) K source drivers each coupled to the input interface, wherein each of the K source drivers has N input data lines, N+1 output data channels, and a set of switches to switch the N input data lines to the N+1 output data channels, where N and K are positive integers, satisfying the relation of: K×N=M, wherein the display cells within column i positioned at the crossing points of the i-th data line and the (2j+1)-th or (2j+2)-th gate line, where j=0, 2, 4, . . . , <[Y/2], and i=1, 2, . . . , M, receive data signals from corresponding data lines 1 through M, respectively, and the display cells within column (i+1) positioned at the crossing points of the (i+1)-th data line and the (2j+1)-th or (2j+2)-th gate line, where j=1, 3, . . . , <[Y/2]+1, and i=1, 2, . . . , M, receive switched data signals from the data lines 2 through M+1, respectively.

11. The display panel driving circuit of claim 10, wherein the display panel comprises a liquid crystal display panel, and wherein the display cells comprise liquid crystal cells.

12. The display panel driving circuit of claim 10, wherein each column of the display cells is driven by three sub pixel data lines mapped into a first output channel, a second output channel and a third output channel for expressing a red color, a green color, and a blue color, respectively.

13. The display panel driving circuit of claim 10, wherein when the (2j+1)-th gate line or (2j+2)-th gate line is scanned, where j=0, 2, 4, . . . , <[Y/2], the output data channels 1 through N of each of the K source drivers receive data signals from a first input data line through the N-th input data line, and the (N+1)-th output data channel becomes a floating output data channel, wherein when (2j+1)-th gate line or (2j+2)-th gate line is scanned, where j=1, 3, . . . , <[Y/2]+1, output data channels 2 though N+1 of each of the K source drivers receive data signals from the first input data channel through the N-th input data channel, and the first output data channel becomes a floating output data channel, and wherein the first output channel of the k-th source driver is connected to the last output data channel of the (k−1)-th source driver, where k=2, 3, . . . , K.

14. A display panel driving circuit for driving a display panel, where the display panel has Y successive gate lines, M+1 successive data lines crossing the Y gate lines forming a plurality of crossing points of the Y gate lines and M+1 data lines, where M and Y are positive integers, and a plurality of display cells, wherein the plurality of display cells are positioned at corresponding crossing points of the Y gate lines and M+1 data lines thereby to form a matrix with a plurality of columns {i=1, 2, . . . , M+1}, wherein display cells within column i positioned at the crossing points of the i-th data line and the (2j+1)-th or (2j+2)-th gate line are connected to the i-th data line, where j=0, 2, 4, . . . , <[Y/2], and display cells within column i+1 positioned at the crossing points of the (i+1)-th data line and the (2j+1)-th or (2j+2)-th gate line are connected to the (i+1)-th data line, where j=1, 3, . . . , <[Y/2]+1, and wherein the i-th data line and the (i+1)-th data line have opposite data signal polarities, respectively, comprising:

(i) a printed circuit board ("PCB");

(ii) an RSDS input interface adapted on the PCB to receive input video signal;

(iii) a timing controller adapted on the PCB to control timing signal for the display panel, wherein the timing controller has M T-CON output channels;

(iv) a plurality of output channels for driving the plurality of display cells; and (v) a plurality of driver data latches adapted on the PCB, wherein each of the plurality of driver data latches has one output data channel, wherein the driver data latches 1 through M receive data signals from the T-CON output channels 1 through M, when the (2j+1)-th or (2j+2)-th gate line is scanned, where j=0, 2, 4, . . . , <[Y/2], such that the display cells within column i positioned at the crossing points of the i-th data line and the (2j+1)-th or (2j+2)-th gate line, where j=0, 2, 4, . . . , <[Y/2], and i=1, 2, . . . , M, receive data signals from the T-CON output channels 1 through M, respectively, and wherein the driver data latches 1 through M receive the data signals from T-CON output channels 1 though M, when the (2j+1)-th or (2j+2)-th gate line is scanned, where j=1, 3, . . . , <[Y/2]+1, such that the display cells within column (i+1) positioned at the crossing points of the (i+1)-th data line and the (2j+1)-th or (2j+2)-th gate line, where j=1, 3, . . . , <[Y/2]+1, and i=1, 2, . . . , M, receive shifted data signals from the T-CON output channels 2 through M+1, respectively, wherein every even numbered blue sub pixel data line is shifting by one-sub pixels by the timing controller.

15. The display panel driving circuit of claim 14, wherein the display panel comprises a liquid crystal display panel, and wherein the display cells comprise liquid crystal cells.

16. The display panel driving circuit of claim 14, wherein each column of the display cells is driven by three sub pixel data lines mapped into a first output channel, a second output channel and a third output channel for expressing a red color, a green color, and a blue color, respectively.

17. The display panel driving circuit of claim 14, further comprising a Mini-LVDS input interface, and wherein for the Mini-LVDS input interface, when the (2j+1)-th or (2j+2)-th gate line is scanned, where j=0, 2, 4, . . . , <[Y/2], the driver data latches 1 through M receive the data signal from T-CON output channels 1 though M, and wherein when the (2j+1)-th or (2j+2)-th gate line is scanned, where j=1, 3, . . . , <[Y/2]+1, the driver data latches 1 through M receive the data signal from T-CON output channels 1 though M, and every even numbered blue sub pixel data line is shifting by two sub pixels by the timing controller.

* * * * *